US010658755B2

(12) United States Patent
Hashimoto et al.

(10) Patent No.: US 10,658,755 B2
(45) Date of Patent: May 19, 2020

(54) PLANAR ANTENNA

(71) Applicant: KABUSHIKI KAISHA TOSHIBA, Tokyo (JP)

(72) Inventors: Koh Hashimoto, Kanagawa (JP); Makoto Higaki, Tokyo (JP); Manabu Mukai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 290 days.

(21) Appl. No.: 15/239,173

(22) Filed: Aug. 17, 2016

(65) Prior Publication Data

US 2017/0054217 A1 Feb. 23, 2017

(30) Foreign Application Priority Data

Aug. 20, 2015 (JP) ..... 2015-162881

(51) Int. Cl.
*H01Q 9/28* (2006.01)
*H01Q 9/04* (2006.01)
*H01Q 21/06* (2006.01)

(52) U.S. Cl.
CPC ..... *H01Q 9/0457* (2013.01); *H01Q 9/0407* (2013.01); *H01Q 21/065* (2013.01)

(58) Field of Classification Search
CPC ..... H01Q 1/38; H01Q 9/0407; H01Q 9/0457; H01Q 21/065; H01Q 1/2283; H01C 9/0407; H01C 9/0457; H01C 21/065; H01L 23/481
See application file for complete search history.

(56) References Cited

U.S. PATENT DOCUMENTS 5,355,143 A * 10/1994 Zurcher ..... H01Q 9/0407 343/700 MS
5,510,803 A * 4/1996 Ishizaka ..... H01Q 21/061 343/700 MS
6,191,740 B1 * 2/2001 Kates ..... H01Q 1/38 343/700 MS
6,518,864 B1 2/2003 Ito et al.
(Continued)

FOREIGN PATENT DOCUMENTS

JP 4-284004 10/1992
JP H5-267931 A 10/1993
(Continued)

*Primary Examiner* — Ab Salam Alkassim, Jr.
(74) *Attorney, Agent, or Firm* — Finnegan, Henderson, Farabow, Garrett & Dunner, L.L.P.

(57) ABSTRACT

A plane antenna device includes a multi-layered dielectric substrate having a plurality of dielectric layers; a first conductive plane on or in the multi-layered dielectric substrate; a second conductive plane on or in the multi-layered dielectric substrate, wherein at least first and second dielectric layers of the plurality of dielectric layers are disposed between the first and second conductive planes; a first signal line being between the at least first and second dielectric layers, the first signal line being between the first conductive plane and the second conductive plane; a first conductive via in the first dielectric layer, the first conductive via being distanced from the first signal line; and a second conductive via in the second dielectric layer, the second conductive via being distanced from the first signal line, the second conductive via being aligned to the first conductive via.

8 Claims, 15 Drawing Sheets

(56) References Cited

U.S. PATENT DOCUMENTS 8,368,596 B2 * 2/2013 Tiezzi ..... H01Q 1/3275 343/700 MS
2002/0067305 A1 6/2002 LeBlanc et al.
2004/0004576 A1 1/2004 Anderson
2005/0128028 A1 6/2005 Sanchez et al.
2006/0038639 A1 * 2/2006 McKinzie, III ..... H01G 4/35 333/219
2006/0043535 A1 * 3/2006 Hiatt ..... H01L 21/76898 257/621
2006/0044188 A1 * 3/2006 Tsai ..... H01Q 9/0407 343/700 MS
2006/0278986 A1 * 12/2006 Trezza ..... H01L 21/76898 257/744
2006/0278989 A1 * 12/2006 Trezza ..... H01L 21/6835 257/773
2006/0281296 A1 * 12/2006 Misra ..... H01L 21/76898 438/618
2006/0281303 A1 * 12/2006 Trezza ..... H01L 21/76898 438/629
2007/0057358 A1 * 3/2007 Satou ..... H01L 25/0657 257/686
2007/0217122 A1 * 9/2007 Gevorgian ..... H01L 21/76838 361/307
2008/0258309 A1 * 10/2008 Chiou ..... H01L 21/76898 257/774
2009/0160020 A1 * 6/2009 Barth ..... H01L 23/5223 257/532
2009/0200682 A1 * 8/2009 Zhang ..... H01L 21/486 257/774
2009/0283895 A1 * 11/2009 Kikuchi ..... H01L 23/5389 257/692
2010/0073238 A1 * 3/2010 Jun ..... H01Q 9/0407 343/700 MS
2010/0090903 A1 * 4/2010 Byun ..... H01Q 9/0407 343/700 MS
2010/0140776 A1 * 6/2010 Trezza ..... H01L 21/76898 257/686
2011/0057853 A1 * 3/2011 Kim ..... H01Q 1/48 343/843
2011/0227673 A1 * 9/2011 Patrick ..... H01P 1/20336 333/203
2011/0261500 A1 * 10/2011 Parris ..... H01G 4/232 361/301.1
2012/0025348 A1 * 2/2012 Marechal ..... H01L 23/642 257/532
2012/0229343 A1 * 9/2012 Sudo ..... H01Q 1/38 343/700 MS
2013/0207869 A1 * 8/2013 Han ..... H01Q 1/36 343/848
2014/0268614 A1 * 9/2014 Zhang ..... H01L 21/768 361/782
2014/0354411 A1 * 12/2014 Pudenz ..... G06K 7/10316 340/10.1
2016/0079672 A1 * 3/2016 Cerreno ..... H01Q 21/065 343/848
2016/0197404 A1 * 7/2016 Hashimoto ..... H01Q 9/0435 343/848
2016/0197406 A1 * 7/2016 Hashimoto ..... H01Q 9/0457 343/848
2016/0204514 A1 * 7/2016 Miraftab ..... H01Q 21/005 343/737
2018/0076530 A1 * 3/2018 Kawahata ..... H01Q 21/08
2019/0341342 A1 * 11/2019 Raorane ..... H01L 23/49816

FOREIGN PATENT DOCUMENTS

JP H8-116211 A 5/1996
JP H11-186837 A 7/1999
JP 2000-261235 9/2000
JP 2000-269707 A 9/2000
JP 2000261235 A * 9/2000
JP 2011-50114 A 3/2011
JP 2014-175829 A 9/2014

* cited by examiner

PLANAR ANTENNA

CROSS-REFERENCE TO RELATED APPLICATION

This application is based on and claims the benefit of priority from Japanese Patent Application No. 2015-162881, filed Aug. 20, 2015, the entire contents of which are incorporated herein by reference.

FIELD

Embodiments described herein relate generally to a planar antenna.

BACKGROUND

In a planar antenna, a strip-line is used to feed a radiating element such as a metal patch to excite the radiating element. In the planar antenna, a parallel-plate mode generated by the excitation of the radiating element propagates. In order to suppress the propagation and to improve various characteristics of the antenna, such as radiation efficiency, a plurality of through holes are provided as electrical conduction between a pair of conductive plates. Reliability of the through holes has been insufficient, because the through holes might be broken by temperature change in the environment of usage or due to long use, so that the suppression effect of the propagation of the parallel-plate mode deteriorates.

DETAILED DESCRIPTION

Figure 1:
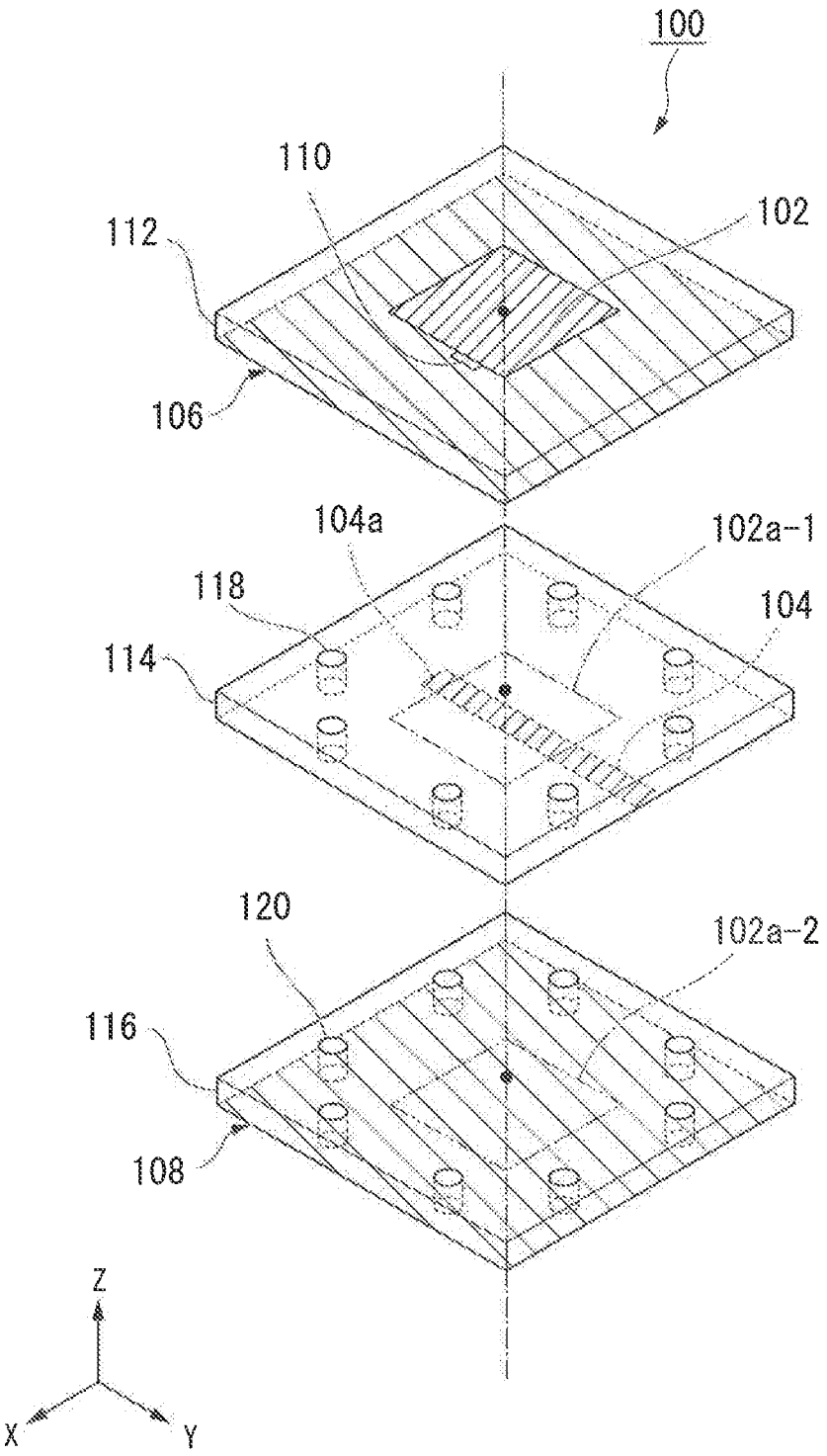
FIG. 1 is an exploded perspective view of a planar antenna of a first embodiment.

In some embodiments, a plane antenna device may include, but is not limited to, a multi-layered dielectric substrate having a plurality of dielectric layers; a first conductive plane on or in the multi-layered dielectric substrate; a second conductive plane on or in the multi-layered dielectric substrate, wherein at least first and second dielectric layers of the plurality of dielectric layers are disposed between the first and second conductive planes; a first signal line being between the at least first and second dielectric layers, the first signal line being between the first conductive plane and the second conductive plane; a first conductive via in the first dielectric layer, the first conductive via being distanced from the first signal line; and a second conductive via in the second dielectric layer, the second conductive via being distanced from the first signal line, the second conductive via being aligned to the first conductive via.

In some cases, the first conductive via in contact with the first conductive plane, and the second conductive via in contact with the second conductive plane.

In some casts, the first conductive via is spaced apart from the first conductive plane, the first conductive via has capacitive coupling with the first conductive plane. The second conductive via is spaced apart from the second conductive plane, and the second conductive via has capacitive coupling with the second conductive plane.

In other cases, the first conductive via is in contact with the first conductive plane. The second conductive via is spaced apart from the second conductive plane, and the second conductive via has capacitive coupling with the second conductive plane.

In other cases, the first conductive via is spaced apart from the first conductive plane, and the first conductive via has capacitive coupling with the first conductive plane. The second conductive via is in contact with the second conductive plane.

In other cases, the first and second dielectric layers are adjacent to each other. The first and second conductive vias are in contact with each other.

In other cases, the first and second dielectric layers are adjacent to each other. The first and second conductive vias are in capacitive coupling with each other.

In other cases, the plane antenna device may further include, but is not limited to, an adhesive layer between the first and second conductive vias.

In other cases, the plane antenna device may further include, but is not limited to, a radiating element on the multi-layered dielectric substrate, the radiating element being spaced apart from the first and second conductive planes. The first conductive plane has an aperture, and at least a part of the aperture is covered by the radiating element. At least a part of the first signal line and the at least part of the aperture are aligned to each other.

In other cases, the radiating element is spaced apart from the first signal line.

In other cases, the plane antenna device may further include, but is not limited to, a radiating element in the multi-layered dielectric substrate, the radiating element being between the first and second conductive planes. The first conductive plane has an aperture, and at least a part of the aperture is aligned to at least a part of the radiating element. The radiating element is connected directly with the first signal line.

In other cases, the first conductive plane has an aperture. At least a part of the signal line and at least a part of the aperture are aligned to each other.

In other cases, the plane antenna device may further include, but is not limited to, a first conductive pattern between the first and second conductive vias, the first conductive pattern being connected directly with the first conductive via.

In other cases, the plane antenna device may further include, but is not limited to, a second signal line being between the at least first and second dielectric layers, the second signal line being between the first conductive plane and the second conductive plane, the second signal line being electrically connected to the first signal line; a first radiating element connected to the first signal line; and a second radiating element connected to the second signal line.

In other cases, the plane antenna device may further include, but is not limited to, a first radiating element on the multi-layered dielectric substrate; a second radiating element on the multi-layered dielectric substrate, the second radiating element being spaced apart from the first radiating element; and a second signal line being between the at least first and second dielectric layers. The second signal line is between the first conductive plane and the second conductive plane, the second signal line being electrically connected to the first signal line. At least a part of the first signal line is covered by at least a part of the first radiating element. At least a part of the second signal line is covered by at least a part of the second radiating element.

In other cases, the plane antenna device may further include, but is not limited to, a two-dimensional array of radiating elements; and a plurality of signal lines including the first signal line, each of the plurality of signal lines being electrically connected to an associated one of the radiating elements. The plurality of signal lines is between the at least first and second dielectric layers. The plurality of signal lines is between the first conductive plane and the second conductive plane. The plurality of signal lines is electrically connected to each other.

In other cases, the plane antenna device may further include, but is not limited to, a two-dimensional array of radiating elements spaced apart from each other, the two-dimensional array of radiating elements being on the multi-layered dielectric substrate; and a plurality of signal lines including the first signal line. The plurality of signal lines is between the at least first and second dielectric layers. The plurality of signal lines is between the first conductive plane and the second conductive plane. The plurality of signal lines is electrically connected to each other. At least a part of each of the plurality of signal lines is covered by at least a part of an associated one of the plurality of radiating elements.

In other cases, the two-dimensional array of radiating elements are a $2^N \times 2^N$ two-dimensional matrix, where N is a natural number of 2 or greater.

In other cases, the plurality of radiators are provided in a $2^N \times 2^N$ two-dimensional matrix, where N is a natural number of 2 or greater.

In other cases, the two-dimensional array of radiating elements are a $2^N \times 2^{N-1}$ two-dimensional matrix, where N is a natural number of 2 or greater.

In other cases, the plurality of radiators are provided in a $2^N \times 2^{N-1}$ two-dimensional matrix, where N is a natural number of 2 or greater.

In another embodiment, a plane antenna device may include, but is not limited to, a first conductive plane; a first dielectric layer adjacent to the first conductive plane; a first signal line adjacent to the first dielectric layer, the first signal line being separated from the first conductive plane by the first dielectric layer; a second dielectric layer adjacent to the first signal line and to the first dielectric layer, the first signal line being between the first and second dielectric layers; a second conductive plane adjacent to the second dielectric layer, the second conductive plane being separated from first signal line by the second dielectric layer; a first conductive via in the first dielectric layer, the first conductive via being connected to the first conductive plane; and a second conductive via in the second dielectric layer, the second conductive via being connected to the second conductive plane, the second conductive via being aligned to the first conductive via.

In another embodiment, a plane antenna device may include, but is not limited to, a first conductive plane; a first dielectric layer adjacent to the first conductive plane; a first signal line adjacent to the first dielectric layer, the first signal line being separated from the first conductive plane by the first dielectric layer; a second dielectric layer adjacent to the first signal line and to the first dielectric layer, the first signal line being between the first and second dielectric layers; a second conductive plane adjacent to the second dielectric layer, the second conductive plane being separated from the first signal line by the second dielectric layer; a third dielectric layer adjacent to the second conductive plane; a second signal line adjacent to the third dielectric layer, the second signal lime being separated from the second conductive plane by the third dielectric layer, the second signal line extending cross the first signal line in a view of a direction vertical to the first and second conductive planes; a fourth dielectric layer adjacent to the second signal line and to the third dielectric layer, the second signal line being between the third and fourth dielectric layers; a third conductive plane adjacent to the fourth dielectric layer, the third conductive plane being separated from the second signal line by the fourth dielectric layer, a first conductive via in the first dielectric layer, the first conductive via being connected to the first conductive plane; a second conductive via in the second dielectric layer, the second conductive via being connected to the second conductive plane, the second conductive via being aligned to the first conductive via; and a third conductive via in the third dielectric layer, a fourth conductive via in the fourth dielectric layer, the fourth conductive via being connected to the third conductive plane, the fourth conductive via being aligned to the third conductive via.

Planar antennas of embodiments will be described below, with references made to the drawings.

(First Embodiment)

Figure 2:
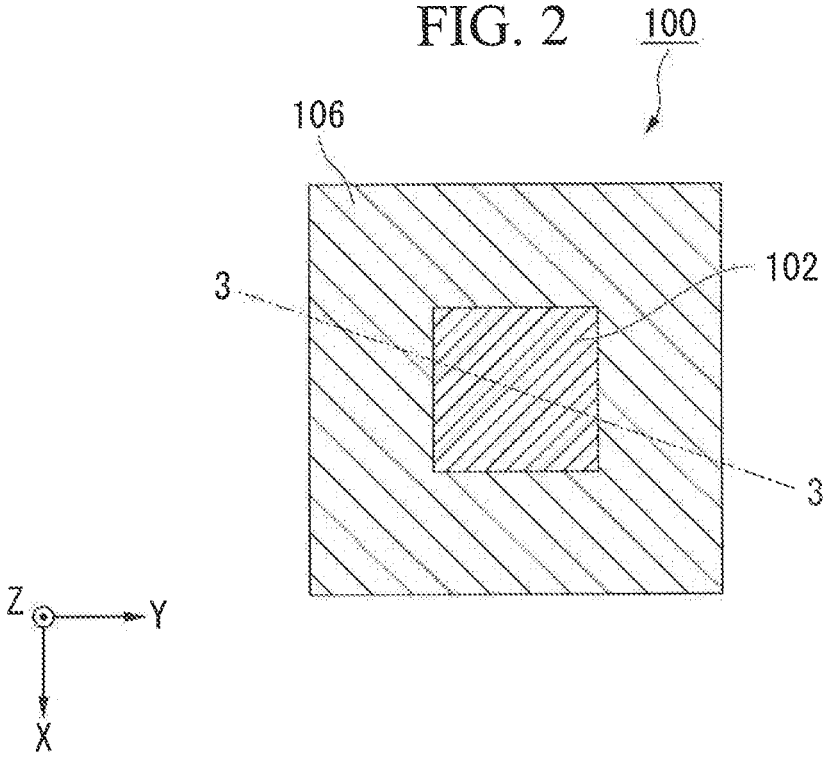
FIG. 2 is a top plan view of the planar antenna of the first embodiment.
Figure 3:
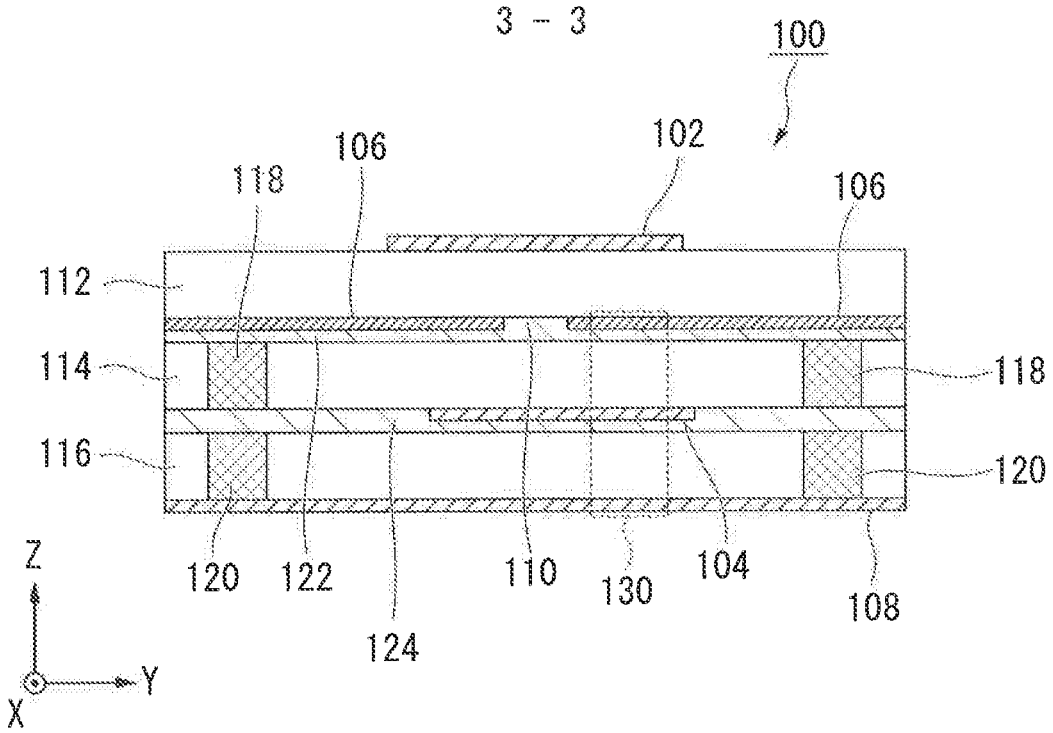
FIG. 3 is a cross-sectional view of the planar antenna of the first embodiment along line 3-3.

The planar antenna 100 of the first embodiment will now be described. FIG. 1 is an exploded perspective view of the planar antenna 100 of the first embodiment. FIG. 2 is a top plan view of the planar antenna 100 of the first embodiment. FIG. 3 is a cross-sectional view of the planar antenna 100 of the first embodiment along the line 3-3.

The planar antenna 100 of the first embodiment, as shown in FIG. 1, includes a radiating element (radiator) 102, a first signal line 104, a first conductive plane 106, a second conductive plane 108, a slot 110, a multi-layered dielectric substrate (112, 114, and 116), first conductive vias 118, and second conductive vias 120. The multi-layered dielectric substrate (112, 114, and 116) includes a plurality of dielectric layers (112, 114, and 116). The plurality of dielectric layers, for example, may be, but not limited to, a first dielectric layer 112, a second dielectric layer 114, and a third dielectric layer 116. Although the first embodiment is described in case that the planar antenna 100 includes the multi-layered dielectric substrate having the three dielectric layers (112, 114, and 116), the number of the dielectric layers in the multi-layered dielectric substrate is optional and should not limited to a particular number.

The radiating element 102 is on the multi-layered dielectric substrate. The radiating element 102 is spaced apart from the first conductive plane 106 and second conductive plane 108. The radiating element 102 is a microstrip antenna. The radiating element 102 is excited by feeding a signal to the first signal line 104 or by receiving electromagnetic waves. The radiating element 102 is, for example, a metal patch. The shape of the radiating element 102 of a metal patch is rectangular, for example, may be square, as shown in FIG. 2 in plan view in Z direction in FIG. 1. The plan-view shape of the radiating element 102 is not limited to a rectangle, and may be, for example, other polygons, circulars, or some other shapes. The radiating element 102 is formed, for example, by patterning an electrically conductive material on the surface on the positive Z. direction side of the first dielectric substrate 112. The first dielectric substrate 112 is formed by an insulator, such as a resin substrate of PTFE (polytetrafluoroethylene) or epoxy, a foamed plastic of resin that has been foamed, or a film substrate such as a liquid crystal polymer. The radiating element 102 has the center.

The first signal line 104 is between the at least the second dielectric layer 114, and the third dielectric layer 116. The first signal line 104 is between the first conductive plane 106 and the second conductive plane 108. The first signal line 104 extends across the center of the radiating element 102 in a view of a direction vertical to the surface of the radiating element 102. The first signal line 104 may extend straight and may have a longitudinal center line which is aligned to the center of the radiating element 102 in a view of the direction vertical to the surface of the radiating element 102. The center of the radiating element 102 is, for example, at the center of the rectangle or at the center of gravity thereof. When a signal is fed to the first signal line 104 or when electromagnetic waves are received by the radiating element 102, the first signal line 104 electromagnetically couples with the radiating element 102 and causes an electrical current through a strip-line (tri-plate) 130 such as shown in FIG. 3. The first signal line 104 is formed, for example, by patterning an electrically conductive material on a surface of the second dielectric layer 114, wherein the surface faces the third dielectric layer 116. The first signal line 104 is disposed between the first conductive plane 106 and the second conductive plane 108. For example, the first signal line 104 may be formed on a surface on the third dielectric substrate 116 of the side of the second dielectric layer 114.

The first dielectric layer 112, the second dielectric layer 114 and third dielectric layer 116 may be formed of any available insulators, for example, insulating resins such as PTFE (polytetrafitioroethylene), epoxy, foamed plastics, and liquid crystal polymers.

The first conductive plane 106 is on or in the multi-layered dielectric substrate (112, 114, and 116). The first conductive plane 106 is on the surface of the first dielectric layer 112, wherein the surface faces the second dielectric layer 114. The first conductive plane 106 is formed, for example, by patterning an electrically conductive material on the surface of the first dielectric layer 112.

The second conductive plane 108 is on the multi-layered dielectric layer substrate (112, 114, and 116). The second conductive plane 108 is on the surface of the third dielectric layer 116, wherein the surface opposes to the surface which is in contact with the first signal line 104. The second conductive plane 108 is formed, for example, by patterning an electrically conductive material on the third dielectric layer 116. The third dielectric layer 116 is disposed between the second conductive plane 108 and the first signal line 104.

The first conductive plane 106 has an aperture 110, at least a part of which is covered by the radiating element 102. Atypical example of the aperture may be a slot 110. The plan-view shape of the apertures 110 may be optional, and can be rectangular, H-shaped, dumbbell-shaped, elliptical, or circular.

The first signal line 104, the first conductive plane 106 and the second conductive plane 108 function as a strip-line in combination. The first signal line 104, the first conductive plane 106, and the second conductive plane 108, as shown in FIG. 3, form the strip-line 130. The strip-line 130 electromagnetically couples the radiating element 102 and the first signal line 104, via the slot 110, to allow the planar antenna 100 to perform as a patch-antenna configured to perform slot-coupling feeding. In the planar antenna 100, the slot 110 generates parallel-plate mode between the first conductive plane 106 and the second conductive plane 108.

The first conductive vias 118 are in the second dielectric layer 114. The first conductive vias 118 are distanced from the first signal line 104. The first conductive vias 118 are, for example, metal vias in through holes. The metal vias may be formed by plating or forming a conductive film on side walls of through holes of the second dielectric layer 114, or by filling the through holes with an electrically conductive resin. The first conductive vias 118 are spaced apart from the first conductive plane 106. The first conductive vias 118 capacitively couple with the first conductive plane 106 when a signal is fed to the signal line 104 or when electromagnetic waves are received by the radiating element 102. The first conductive vias 118 may be in electrical contact with the first conductive plane 106.

The first conductive vias 118 are disposed in the periphery around the radiating element 102 in the lamination plane (the XY plane in FIG. 1). The first conductive vias 118 are distanced from the radiating element 102 in the lamination plane. The periphery around the radiating element 102 is the periphery in the lamination plane, meaning outside the orthographically projected region **102*a*-1 when the radiating element 102 is projected in the normal direction of a plane such as the second dielectric layer 114. It is sufficient that the periphery around the radiating element 102 is a region in which a parallel-plate mode is excited between the first conductive plane 106 and the second conductive plane 108. The first conductive vias 118 are distanced from the radiating element 102, for example, on the end 104*a* side, on the sides of the first signal line 104 in the longitudinal direction, and at the base side of the first signal line 104**.

The second conductive vias 120 are in the third dielectric layer 116. The second conductive vias 120 are distanced from the first signal line 104. The second conductive vias 120 are, for example, metal vias in through holes. The metal vias may be formed by plating or forming a conductive film on side walls of through holes of the third dielectric layer 116, or by filling the through holes with an electrically conductive resin. The second conductive vias 120 are spaced apart from the second conductive plane 108. The first conductive vias 120 capacitively couple with the second conductive plane 108 when a signal is fed to the signal line 104 or the radiating element 102 receives electromagnetic waves. The second conductive vias 120 may be in electrical contact with the second conductive plane 108.

The second conductive vias 120 are disposed in the periphery around the radiating element 102 in the lamination plane (the XY plane in FIG. 1). The second conductive vias 120 are distanced from the radiating element 102 in the lamination plane. The periphery around the radiating element 102 is the periphery in the lamination plane, meaning outside the orthographically projected region 102*a*-2 when the radiating element 102 is projected in the normal direction of a plane such as the third dielectric layer 116. It is sufficient that the periphery around the radiating element 102 is a region in which a parallel-plate mode is excited between the first conductive plane 106 and the second conductive plane 108. The first conductive vias 118 are distanced from the radiating element 102, for example, on the end 104*a* side, on the sides of the first signal line 104 in the longitudinal direction, and at the base side of the first signal line 104.

Figure 4:
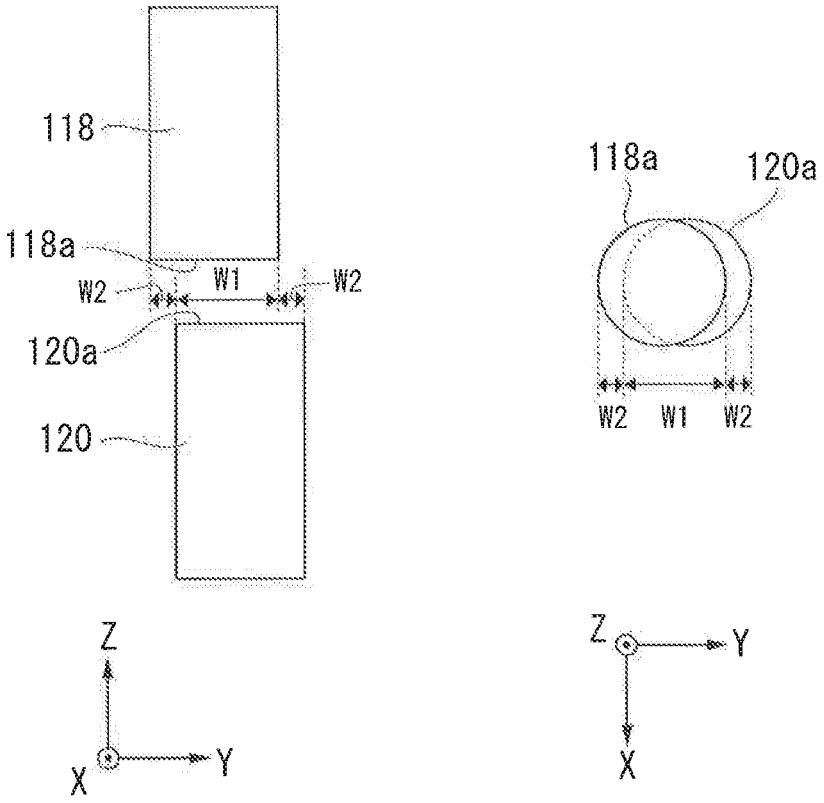
FIG. 4 is drawing describing the positional relationship between a first conductive via and a second conductive via in the planar antenna of the first embodiment.

The first conductive vias 118 are aligned to the second conductive vias 120 in view of a direction vertical to the first and second conductive planes 106 and 108. The second conductive vias 120 are aligned to the first conductive vias 118 in view of a direction vertical to the first and second conductive planes 106 and 108. FIG. 4 shows the positional relationship, in the planar antenna 100 of the first embodiment, between a first conductive vias 118 and a second conductive vias 120. The left drawing in FIG. 4 shows, in schematic form, how the first conductive vias 118 and the second conductive vias 120 are aligned along the normal line direction of the lamination plane. The right drawing in FIG. 4 shows, in schematic form, the positional relationship between the first conductive vias 118 and the second conductive vias 120 when seen in plan view.

The first conductive vias 118 and the second conductive vias 120, as shown in the left drawing of FIG. 4, are aligned along the normal line direction of the lamination plane (Z direction in the left drawing of FIG. 4). The normal line direction of the lamination plane may be the normal line direction of the first conductive plane 106, or may be the normal line direction of the second conductive plane 108. If the first conductive plane 106 and the second conductive plane 108 are laminated in parallel, the normal line directions of the first conductive plane 106 and the second conductive plane 108 coincide. The first conductive vias 118 and the second conductive vias 120 being aligned along the normal line direction of the lamination plane, as shown in the right drawing of FIG. 4, refers to at least a partial overlap between the end face vias 118*a* of the first conductive vias 118 and the end face 120*a* of the second conductive vias 120 when seen in plan view (the case of viewing from the Z direction). The opposing width W1 and the skewed width W2 between the end face via 118*a* of the first conductive vias 118 and the end face 120*a* of the second conductive vias 120 are dependent upon the positional offset between the laminated second dielectric layer 114 and third dielectric layer 116.

At least parts of the first conductive plane 106 and the first conductive vias 118 are adjacent to each other. The first conductive plane 106 and the first conductive vias 118 are separated by a distance so that they are capacitively coupled when a signal is fed to the first signal line 104 or when electromagnetic waves are received by the radiating element 102. In other cases, the first conductive plane 106 and the first conductive vias 118 may be in contact directly or indirectly with a conductor so as to be electrically connected to each other.

At least parts of the first conductive vias 118 and the second conductive vias 120 are adjacent to each other. The first conductive vias 118 and the second conductive vias 120 are separated by a distance so that they are capacitively coupled when a signal is fed to the first signal line 104 or when electromagnetic waves are received by the radiating element 102.

In other cases, the first conductive vias 118 and the second conductive vias 120 may be in contact directly or indirectly with a conductor so as to be electrically connected to each other.

In the planar antenna 100, as shown in FIG. 3, a first adhesive layer 122 may be between first conductive plane 106 and the first conductive vias 118. A second adhesive layer 124 may be between the first conductive vias 118 and the second conductive vias 120. The first adhesive layer 122 adheres the first dielectric layer 112. to the second dielectric layer 114. The second adhesive layer 124 adheres the second dielectric layer 114 to the third dielectric layer 116. The first adhesive layer 122 and the second adhesive layer 124 may be made, for example, of thermoplastic resins, thermosetting resins, or prepregs.

In a pressing process step of laminating the first dielectric layer 112, the second dielectric layer 114, and the third dielectric layer 116, the first adhesive layer 122 is disposed between the first dielectric layer 112 and the second dielectric layer 114. The second adhesive layer 124 is disposed between the second dielectric layer 114 and the third dielectric layer 116. And hot pressing is done in a vacuum environment (also called a reduced-pressure environment). By doing this the first adhesive layer 122 and the second adhesive layer 124 adhere the dielectric layers together. There is a case in which, by the pressing process step, the first adhesive layer 122 and the second adhesive layer 124 remain between the first conductive vias 118 and the second conductive vias 120, and a case in which, by braking due to the pressing process step in the cases, the first adhesive layer 122 and the second adhesive layer 124 do not remain therebetween. If, for example, in the process of manufacturing the first conductive vias 118 and the second conductive vias 120, a conductive land is formed on the surface of the second dielectric layer 114 or on the surface of the second conductive vias 120, the adhesive layer might be broken by the land in the pressing process step. In such a case, at least a part of the first conductive vias 118 and the second conductive vias 120 may be in electrical contact.

As described above, in the planar antenna 100 of the first embodiment, the first conductive vias 118 provided in the second dielectric layer 114 and the second conductive vias 120 provided in the third dielectric layer 116 are aligned along the normal line direction of the lamination plane. Thus, according to this type of the planar antenna 100, high-frequency current flows between the first conductive plane 106, the first conductive vias 118, the second conductive vias 120, and the second conductive plane 108, and the propagation of the parallel-plate mode is suppressed, thereby achieving a planar antenna with high efficiency.

In the planar antenna 100 of the first embodiment, first conductive vias 118 are in the second dielectric layer 114 and second conductive vias 120 are in the third dielectric layer 116, and the second dielectric layer 114 is laminated with the third. dielectric layer 116. In the planar antenna 100 of the first embodiment, this enables the aspect ratio, which is the ratio of the length of the first conductive vias 118 and the second conductive vias 120 in the normal line direction of the lamination plane with respect to the diameter (dimension in the XY plane) of the first conductive vias 118 and the second conductive vias 120 to be made small. That is, in the planar antenna 100, conductive vias are in dielectric layers that between the first conductive plane 106 and the second conductive plane 108 and, by laminating the dielectric layers on which conductive vias are formed, the conductor aspect ratio can be made smaller, compared to the case in which through holes are formed so as to directly connect the first conductive plane 106 and the second conductive plane 108. By doing this, according to the planar antenna 100 of the first embodiment, even if the difference between the coefficients of thermal expansion of the second dielectric layer 114 and the third dielectric layer 116 and the coefficients of thermal expansion of the first conductive vias 118 and the second conductive vias 120 is large, breaks in the first conductive vias 118 and the second conductive vias 120 can be avoided, thereby avoiding deterioration of the suppression effect of the propagation of the parallel-plate mode. As a result, according to the planar antenna 100 of the first embodiment, it is possible to improve the reliability of suppressing effect of the parallel-plate mode propagation.

In this case, in the planar antenna 100 of the first embodiment, if the first conductive plane 106 and first conductive vias 118 are separated by a distance, when a signal is fed to the first signal line 104 or when electromagnetic waves are received by the radiating element 102, the capacitive coupling made between the first conductive plane 106 and the first conductive vias 118 enables a high-frequency current to flow between the first conductive plane 106 and the first conductive plane 108, thereby enabling suppression of the parallel-plate mode propagation.

In the planar antenna 100 of the first embodiment, if the first conductive vias 118 are spaced apart front the second conductive vias 120, the capacitive coupling made between the first conductive vias 118 and the second conductive vias 120. This enables high-frequency current to flow between the first conductive vias 118 and the second conductive vias 120, thereby enabling suppression of the parallel-plate mode propagation.

Also, in the planar antenna 100 of the first embodiment, if the second conductive vias 120 and the second conductive plane 108 are spaced apart, the capacitive coupling made between the second conductive vias 120 and the second conductive plane 108. This enables high-frequency current to flow between the second conductive vias 120 and the second conductive plane 108, thereby enabling suppression of the parallel-plate mode propagation.

Also, in the planar antenna 100 of the first embodiment, if at least apart of the first conductive plane 106 and the first conductive vias 118 are disposed so as to be electrically connected, the flow of high-frequency current between the first conductive plane 106 and the first conductive vias 118 is facilitated, enables further suppression of the parallel-plate mode propagation.

Also, in the planar antenna 100 of the first embodiment, if at least a part of the first conductive vias 118 and the second conductive vias 120 are disposed so as to be electrically connected, the flow of high-frequency current between the first conductive vias 118 and the second conductive vias 120 is facilitated, enabling further suppression. of the parallel-plate mode propagation.

Also, in the planar antenna 100 of the first embodiment, if at least a part of the second conductive vias 120 and the second conductive plane 108 are disposed so as to be electrically connected, the flow of high-frequency current between the second conductive vias 120 and the second conductive plane 108 is facilitated, enabling further suppression of the parallel-plate mode propagation.

Also, in the planar antenna 100 of the first embodiment, the description has been for the electromagnetically coupled feed, via the slot 110 between the radiating element 102 and the first signal line 104, this is not a restriction. The planar antenna 100 of the first embodiment may use a proximity coupled feed system, in which the first signal line 104 is provided directly below the radiating element 102. (in the negative Z direction in FIG. 1) and feeding is done by the electromagnetic coupling between the first signal line 104 and the radiating element 102, or may use a back-feed system, in which there is a connection by a conductor between the radiating element 102 and the first signal line 104.

(Variation Example of the First Embodiment)

Figure 5:
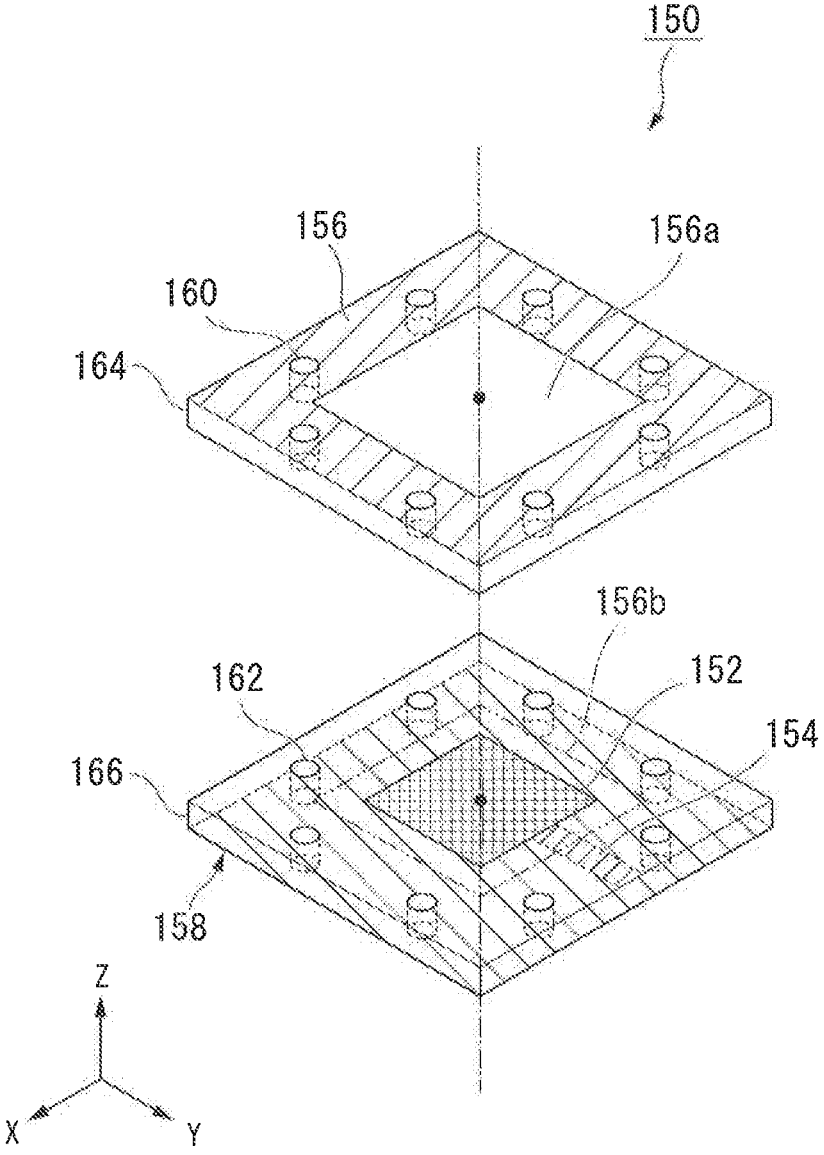
FIG. 5 is an exploded perspective view of a planar antenna, which is a variation example of the first embodiment.
Figure 6:
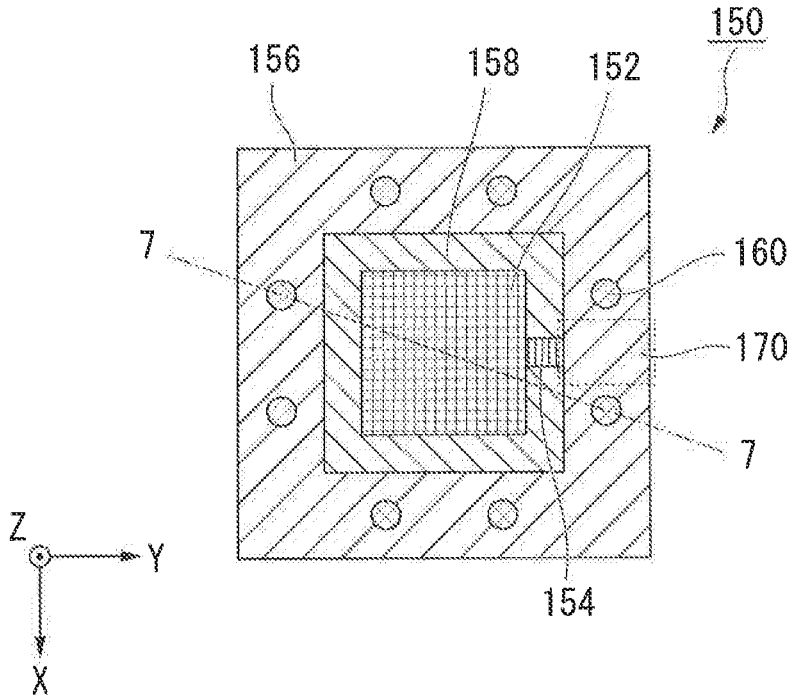
FIG. 6 is a top plan view of the planar antenna, which is a variation example of the first embodiment.
Figure 7:
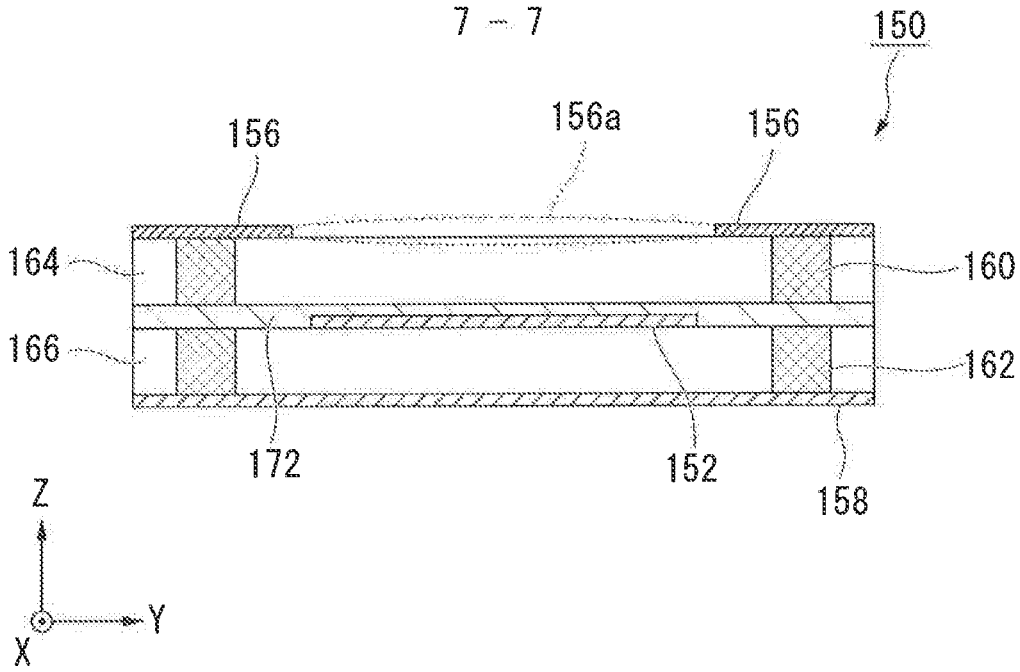
FIG. 7 is a cross-sectional view of the planar antenna, which is a variation example of the first embodiment, along the line 7-7.

A planar antenna 150, which is a variation example of the first embodiment will now be described. FIG. 5 is an exploded perspective view of the planar antenna 150 that is a variation example of the first embodiment. FIG. 6 is a top plan view of the planar antenna 150 that is a variation example of the first embodiment. FIG. 7 is a cross-sectional view of the planar antenna 150 that is a variation example of the first embodiment, along the line 7-7.

The planar antenna 150 that is a variation example of the first embodiment differs from the planar antenna 100 according to the first embodiment with regard to the point of a radiating element 152 and a signal line 154 being disposed on second dielectric layer 166. The planar antenna 150, as shown in FIG. 5, has a radiating element 152, a signal line 154, a first conductive plane 156 provided with an aperture 156*a*, a second conductive plane 158, first conductive vias 160, second conductive vias 162, a first dielectric layer 164, and a second dielectric layer 166. Although FIG. 5 shows the planar antenna 150 as having two dielectric layers (164 and 166), the planar antenna may have an arbitrary number of dielectric layers that is two or greater.

The radiating element 152 is in the multi-layered dielectric substrate (164 and 166) The radiating element 152 is between the first and second conductive planes 156 and 158. The first conductive plane 156 includes an aperture 156*a*, The aperture 156*a* is formed in the first conductive plane 156. The shape of the aperture 156*a* when seen in plan view, for example, is rectangular. At least a part of the aperture 156*a* is aligned to at least apart of the radiating element 152. The radiating element 152 is connected directly with the first signal line 154. The aperture 156*a* is provided in the center of the first conductive plane 156. The radiating element 152 is, for example, a metal patch. The shape of the radiating element 152 when seen in plan view, for example, is rectangular. The size of the radiating element 152 is formed to be smaller than the size of the aperture 156*a*. The radiating element 152 is disposed inside the aperture 156*a*. That is, the radiating element 152 is positioned within the region 156*b*, which is the orthographic projection of the aperture 156*a* in the normal line direction of the plane of the second dielectric layer 166.

The radiating element 152 is excited by feeding a signal to the first signal line 154 or by receiving electromagnetic waves. The shape of the signal line 154 when seen in plan view is, for example, rectangular. The signal line 154 is formed, for example, by patterning an electrically conductive material on the second dielectric layer 166. The signal line 154 may be disposed at an arbitrary position, as long as it is between the first conductive plane 156 and the second conductive plane 158. For example, the signal line 154 may be formed on the second dielectric layer 166. The signal line 154 may be connected, as shown in FIG. 5, to an end part (for example the center of a side) of the radiating element 152.

The signal line 154, the first conductive plane 156 and second conductive plane 158 function as the strip line 170. The strip-line 170 is connected to the radiating element 152 and causes the planar antenna 150 to operate as a coplanar fed patch antenna. in the planar antenna 150, a parallel-plate mode is excited between the first conductive plane 156 and the second conductive plane 158 by the radiating element 152.

The first conductive plane 156 is formed by patterning on the first dielectric layer 164. This forms the first conductive plane 156 above (on the positive Z. direction side of) the signal line 154. The second conductive plane 158 is formed by patterning onto below (on the negative Z direction side of) the second dielectric layer 166. This forms the second conductive plane 158 below the signal line 154.

The first conductive vias 160 is in the first dielectric layer 164. The first conductive vias 160 is electrically connected with the first conductive plane 156. The first conductive vias 160 and the first conductive plane 156 may be spaced to he mutually opposing at a distance so that, when a signal is fed to the signal line 154 or when electromagnetic waves are received by the radiating element 152, the first conductive vias 160 and the first conductive plane 156 are capacitively coupled. The first conductive vias 160 are disposed in the periphery around the aperture 156*a* in the lamination plane (XY plan in the added drawing FIG. 1). The peripheral around the aperture 156*a* means on the outside of the periphery in the lamination plane. It is sufficient that the periphery of the aperture 156*a* be a region in which a parallel-plate mode is excited between the first conductive plane 156 and the second conductive plane 158.

The second conductive vias 162 in the second dielectric layer 166 in the thickness direction. Each second conductive via 162 has one end electrically connected with the second conductive plane 158. The second conductive vias 162 and the second conductive plane 158 may be spaced to be mutually opposing at a distance so that, when a signal is fed to the signal line 154 or when electromagnetic waves are received by the radiating element 152, the second conductive vias 162 and the second conductive plane 158 are capacitively coupled. The second conductive vias 162 are disposed in the periphery around the region 156*b*, which is the orthographic projection of the aperture 156*a* projected along the normal line direction onto the plane of the second dielectric layer 166 in the lamination plane (XY plane in the drawing FIG. 5). The periphery around the region 156*b*, which is the orthographic projection of the aperture 156*a* projected along the normal line direction onto the plane of the second dielectric layer 166 is the periphery in the lamination plane, which means outside the region 156*b* when the aperture 156*a* is orthographically projected along the normal line direction onto the plane of the second dielectric layer 166. It is sufficient that the periphery around the aperture 156*b*, which is the orthographic projection of the aperture 156*a* projected along the normal line direction onto the plane of the second dielectric layer 166 is a region in which a parallel-plate mode is excited between the first conductive plane 156 and the second conductive plane 158.

Similar to the first conductive vias 118 and the second conductive vias 120 of the first embodiment, as shown in the left drawing of FIG. 4, the first conductive vias 160 and the second conductive vias 162 are aligned along the normal line direction (Z direction in the left drawing of FIG. 4) of the lamination plane. The first conductive vias 160 and the second conductive vias 162 are disposed so that, at least a part thereof is in mutual proximity. The first conductive vias 160 and the second conductive vias 162 being in mutual proximity refers to the first conductive vias 160 and the second conductive vias 162 being separated by a distance so that they are capacitively coupled when a signal is fed to the signal line 154 or when electromagnetic waves are received by the radiating element 152. The first conductive vias 160 and the second conductive vias 162 may partially be in contact and electrically connected.

As described above, in the planar antenna 150, which is a variation example of the first embodiment, the first conductive vias 160 provided in the first dielectric layer 164 and the second conductive vias 162 provided in the second dielectric layer 166 are aligned along the normal line direction of the lamination plane. Thus, similar to the first embodiment, high-frequency current can flow between the first conductive plane 156, and the first conductive vias 160 and between the first conductive vias 160 and the second conductive vias 162, and between the second conductive vias 162 and the second conductive plane 158, and the propagation of the parallel-plate mode is suppressed, thereby achieving an antenna device with high efficiency. According to the planar antenna 150 that is a variation example of the first embodiment, similar to the first embodiment, the aspect ratio (as described earlier) of the first conductive vias 160 and the second conductive vias 162 can be made small, thereby enabling improvement of the reliability of suppressing effect of the parallel-plate mode propagation.

(Second Embodiment)

Figure 8:
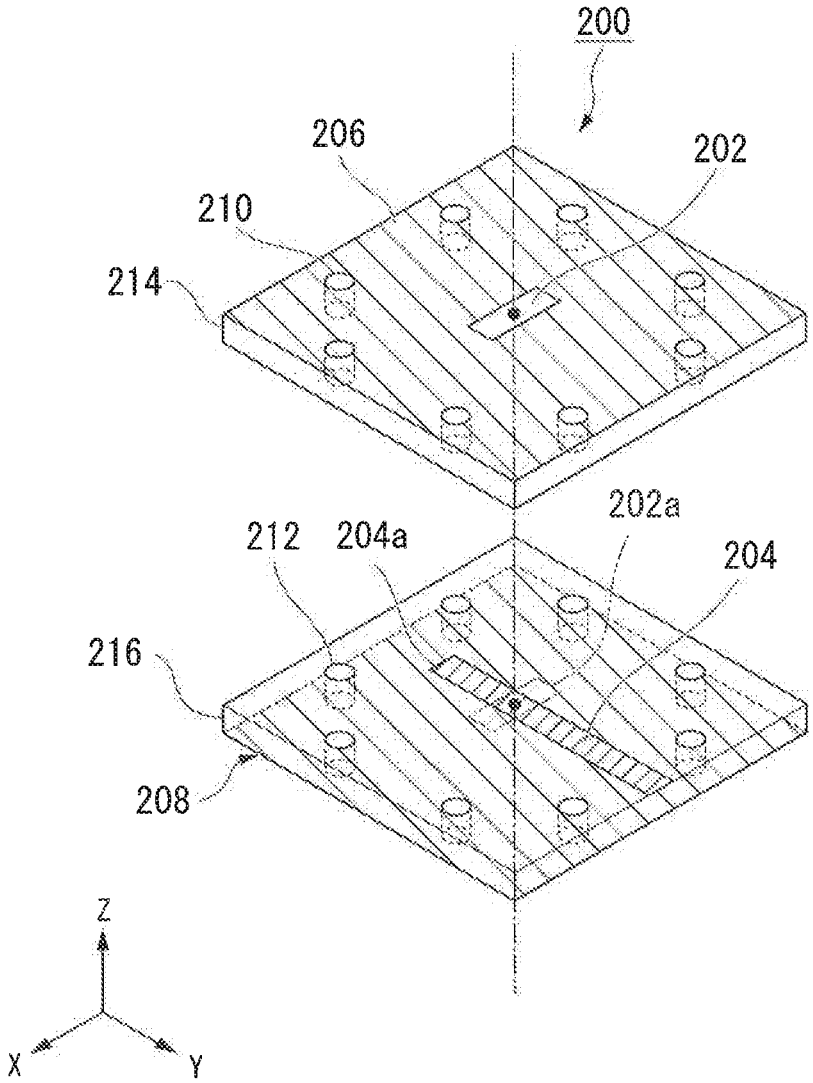
FIG. 8 is an exploded perspective view of a planar antenna of a second embodiment.
Figure 9:
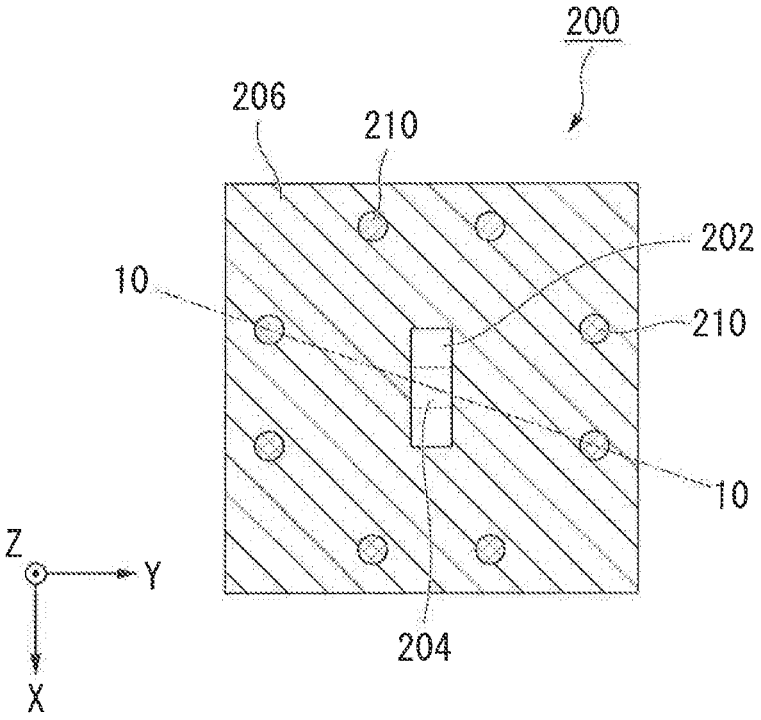
FIG. 9 is a top plan view of the planar antenna of the second embodiment.
Figure 10:
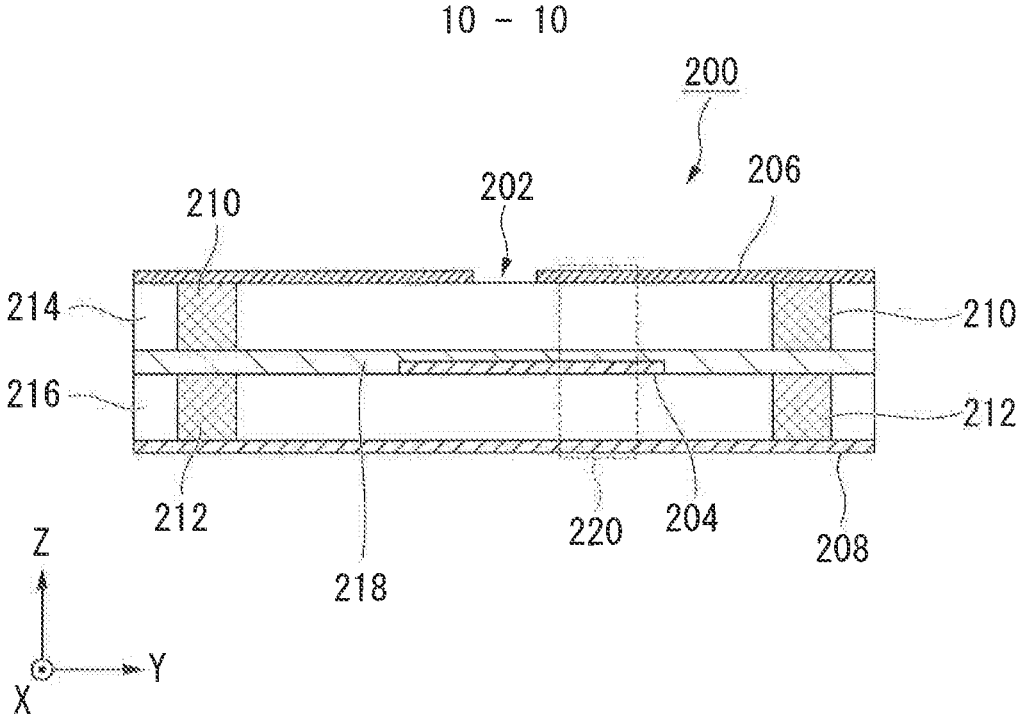
FIG. 10 is a cross-sectional view of the planar antenna of the second embodiment, along the line 10-10.

A planar antenna 200 of the second embodiment will now be described. FIG. 8 is an exploded view of the planar antenna 200 of the second embodiment. FIG. 9 is atop plan view of the planar antenna 200 of the second embodiment. FIG. 10 is a cross-sectional view of the planar antenna 200 of the second embodiment, along the line 10-10.

The planar antenna 200 of the second embodiment differs from the above-described embodiment with regard to the point of the radiator being a slot. The planar antenna 200 of the second embodiment, as shown in FIG. 8, has a slot 202, a signal line 204, a first conductive plane 206, a second conductive plane 208, first conductive vias 210, second conductive vias 212, a first dielectric layer 214, and a second dielectric layer 216. In the drawing, the reference symbol 218 is an adhesive layer. Although there are two dielectric layers (214 and 216) in the second embodiment, the planar antenna may have an arbitrary number of dielectric layers of two or greater.

The slot 202 is a slot antenna, which is excited when a signal is fed to the signal line 204 or when electromagnetic waves are received. As shown in FIG. 10, the slot 202 is formed by an aperture in the first conductive plane 206 formed onto the plane in the normal line direction (positive Z direction in FIG. 10) side of the first dielectric layer 214 in the lamination plane. The shape of the slot 202 when viewed from the Z direction is, for example, rectangular.

When a signal is fed or when electromagnetic waves are received by the slot 202, the signal line 204 is electromagnetically coupled with the slot 202. The plan-view shape of the signal line 204 is, for example, rectangular. The signal line 204 is formed, for example, by an electrically conductive material patterned onto the surface of first conductive plane 206 side of the second dielectric layer 216. The signal line 204 may be disposed at an arbitrary location, as long as it is between the first conductive plane 206 and the second conductive plane 208. For example, it may be formed on the second conductive plane 208 side of the first dielectric layer 214. A part of the signal line 204, as shown in FIG. 9, is disposed at the first conductive plane 206 side of the center part (for example, the center) of the slot 202.

The signal line 204 is between the first conductive plane 206 and the second conductive plane 208. As shown in FIG. 10, the signal line 204, the first conductive plane 206, and the second conductive plane 208 function as the strip-line 220. The strip-line 220 electromagnetically couples the slot 202 and the signal line 204, and causes the planar antenna 200 to operate as a slot antenna. In the planar antenna 200, a parallel-plate mode is excited by the slot 202 and the parallel-plate mode propagates between the first conductive plane 206 and the second conductive plane 208.

The first conductive plane 206 is on the first dielectric layer 214. This forms the first conductive plane 206 on the upper side of the signal line 204 (positive Z direction side in FIG. 8). The second conductive plane 208 is formed, for example, by patterning onto the plane of the lower side of the second dielectric layer 216. This forms the second conductive plane 208 on the lower side of the signal line 204.

The first conductive vias 210 are in the first dielectric layer 214. One end of the first conductive via 210 is electrically connected with the first conductive plane 206. One end of the first conductive vias 210 on the ,upper side (positive Z direction in FIG. 10) may be opposite to, and spaced apart from the first conductive plane 206 so that, when a signal is fed to the signal line 204 or when electromagnetic waves are received by the signal line 204 via the slot 202, the first conductive vias 210 and the first conductive plane 206 are capacitively coupled to each other. The first conductive vias 210 are disposed in the periphery around the slot 202 in the lamination plane (XY plane in FIG. 8). The periphery around the slot 202 is the periphery in the lamination plane, meaning outside the region 202*a*, which is the orthographic projection of the radiating element 202 projected along the normal line direction onto the plane of, for example, the second dielectric layer 214. It is sufficient that the periphery around the slot 202 be a region in which a parallel-plate mode is excited between the first conductive plane 206 and the second conductive plane 208. The first conductive vias 210 are formed in the periphery around the slot 202 and, for example, on the end 204*a* of the signal line 204 side, the sides of the signal line 204 in the longitudinal direction, and the base side of the signal line 204.

The second conductive vias 212 are in the second dielectric layer 216 in the thickness direction. The lower side ends (negative Z direction in FIG. 10) of the second conductive vias 212 are electrically connected with the second conductive plane 208. The second conductive vias 212 may be opposite to, and spaced apart from the second conductive plane 208 by a distance so that, when a signal is fed to the signal line 204 or when electromagnetic waves are received by the signal line 204 via the slot 202, the second conductive vias 212 and the second conductive plane 208 are capacitively coupled to each other. The second conductive vias 212 are disposed in the periphery around the slot 202 in the lamination plane (XY plant in FIG. 8). The periphery around the slot 202 is the periphery in the lamination plane, meaning outside the region 202*a*, which is the orthographic projection of the slot 202 projected along the normal line direction onto the plane of, for example, the second dielectric layer 216. It is sufficient that the periphery around the slot 202 be a region in which a parallel-plate mode is excited between the first dielectric layer 214 and the second dielectric layer 216, The second conductive vias 212 are formed in the periphery around the slot 202 and, for example, on the end 204*a* of the signal line 204 in the longitudinal direction, the sides of the signal line 204 in the longitudinal direction, and the base side of the signal line 204.

The first conductive vias 210 and the second conductive vias 212, similar to the first conductive vias 118 and the second conductive vias 120 in the first embodiment, as shown in FIG. 4, are aligned along the normal line direction (Z direction in the left drawing of FIG. 4) of the lamination plane. The first conductive vias 210 and the second conductive vias 212 may be disposed so that they are at least partially in mutual proximity. The first conductive vias 210 and the second conductive vias 212 being in proximity means that, when a signal is fed to the signal line 204 or when electromagnetic waves are received by the slot 202, the first conductive vias 210 and the second conductive vias 212 are spaced apart by a distance at which they are capacitively coupled. At least a part of the first conductive vias 210 and the second conductive vias 212 may partially be in contact and electrically connected.

As described below, in the planar antenna 200 of the second embodiment, the first conductive vias 210 provided in the first dielectric layer 214 and the second conductive vias 212 provided in the second dielectric layer 216 are aligned along the normal line direction of the lamination plane. Thus, according to the planar antenna 200, similar to the first embodiment, high-frequency current flows between the first conductive plane 206, the first conductive vias 210, the second conductive vias 212, and the second conductive plane 208, and the propagation of the parallel-plate mode is suppressed, thereby achieving an antenna device with high efficiency. According to the planar antenna 200 of the second embodiment, similar to the first embodiment, the aspect ratio (described above) of the first conductive vias 210 and the second conductive vias 212 can be made small, and the reliability of suppressing effect of the parallel-plate mode propagation can be improved.

(Third Embodiment)

Figure 11:
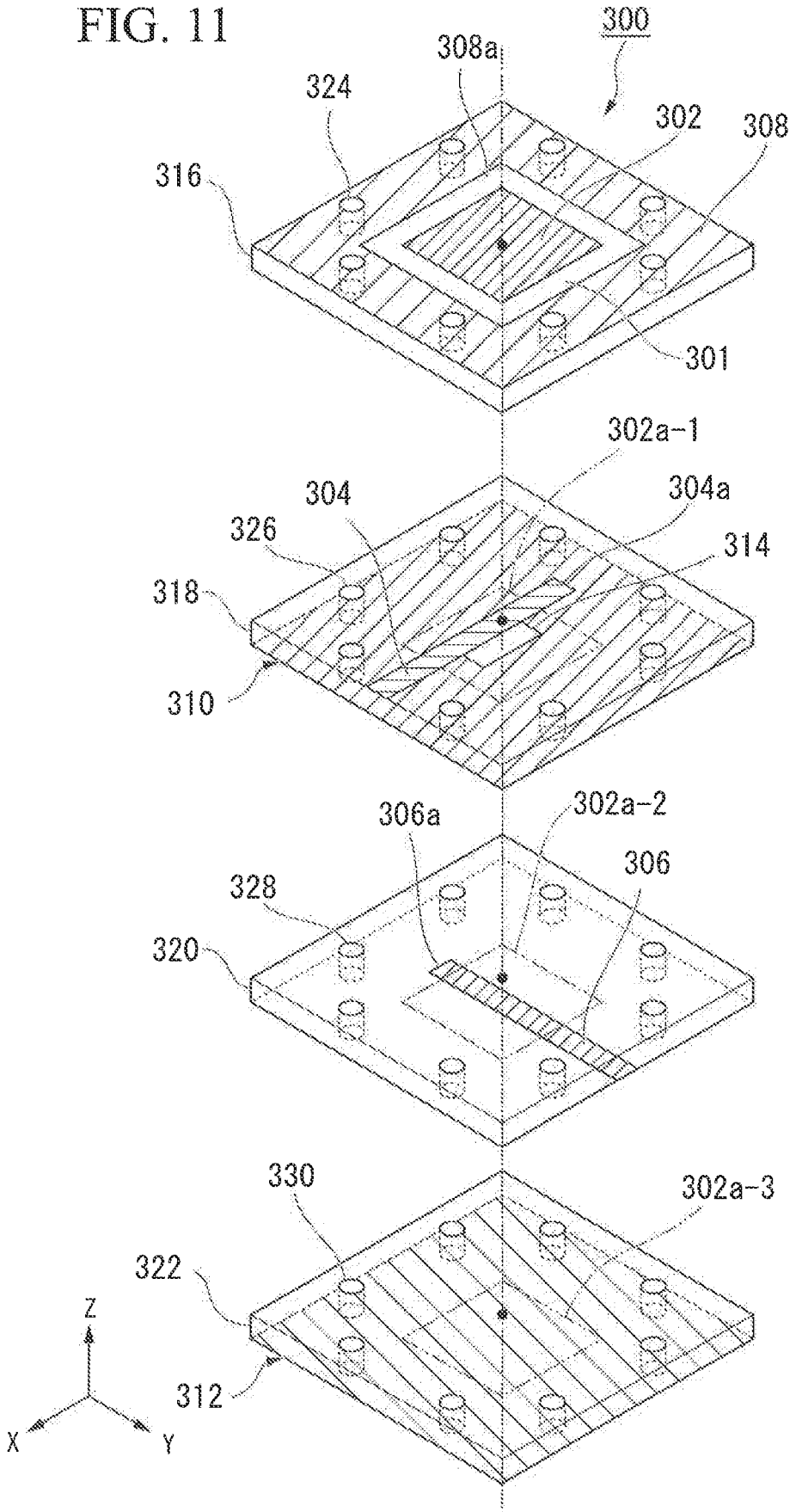
FIG. 11 is an exploded perspective view of a planar antenna of a third embodiment.
Figure 12:
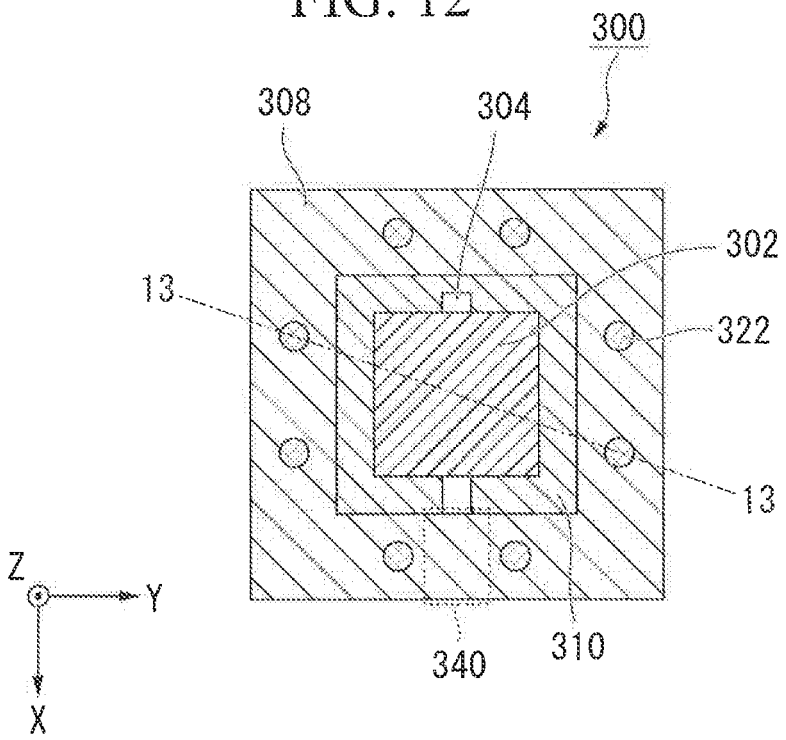
FIG. 12 is a top plan view of the planar antenna of the third embodiment.
Figure 13:
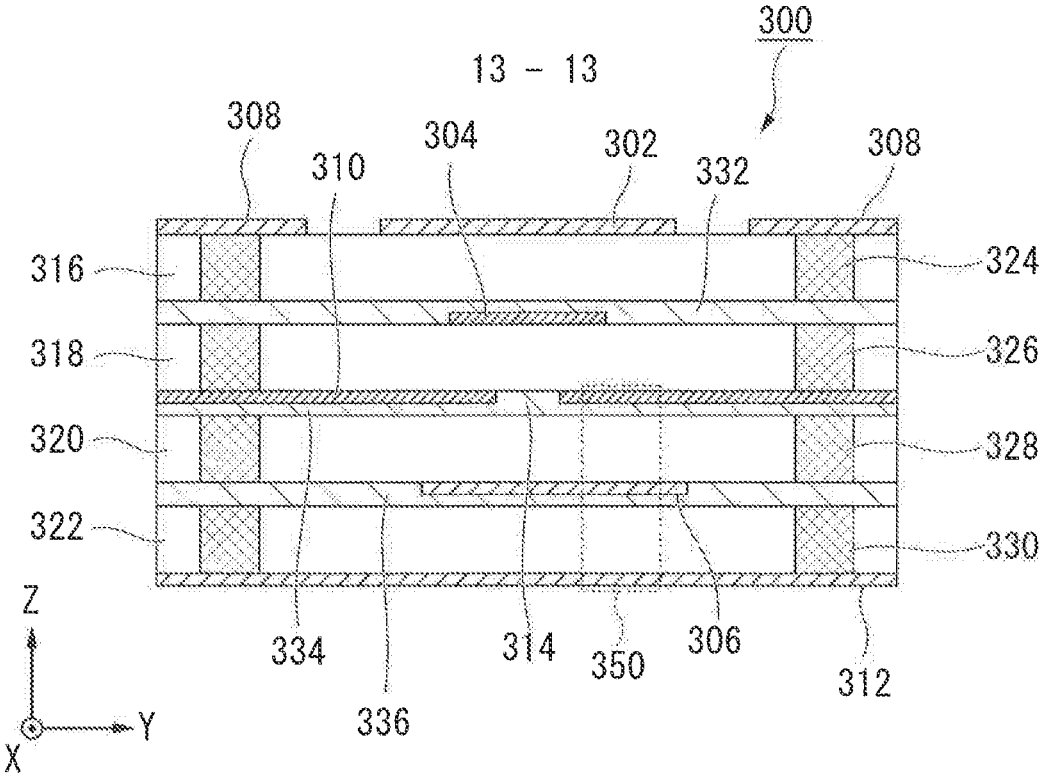
FIG. 13 is a cross-sectional view of the planar antenna of the third embodiment, along the line 13-13.

The planar antenna 300 of the third embodiment will now be described. FIG. 11 is an exploded perspective view of the planar antenna 300 of the third embodiment. FIG. 12 is atop plan view of the planar antenna 300 of the third embodiment. FIG. 13 is a cross-sectional view of the planar antenna 300 of the third embodiment, along the line 13-13.

The planar antenna 300 of the third embodiment differs from the above-described embodiments with regard to having two signal lines. As shown in FIG. 11, the planar antenna 300 has a radiating element 302, a first signal line 304, a second signal line 306, a first conductive plane 308 that is provided with an aperture 308*a*, a second conductive plane 310, a third conductive plane 312, a slot 314, a first dielectric layer 316, a second dielectric layer 318, a third dielectric layer 320, a fourth dielectric layer 322, first conductive vias

324, second conductive vias 326, third conductive vias 328, and fourth conductive vias 330. The reference symbol 332 in the drawing is a first adhesive layer, the reference symbol 334 is the second adhesive layer, and the reference symbol 336 is the third adhesive layer. Although the drawing shows four dielectric layers (316, 318, 320, and 322) in the third embodiment, the planar antenna may have an arbitrary number of dielectric layers greater than two.

The radiating element 302. and the first conductive plane 308 are formed on the surface of the upper side (positive Z direction in FIG. 11) of the first dielectric layer 316. An aperture 308*a* is formed in the first conductive plane 308. The plan-view shape of the aperture 308*a* is, for example, rectangular. The aperture 308*a* is provided in the center of the first conductive plane 308. The radiating element 302 is, for example, a metal patch. The plan-view shape of the radiating element 302 is, for example, rectangular. The size of the radiating element 302 is formed to be smaller than the size of the aperture 308*a*. The radiating element 302 is disposed inside the aperture 308*a*.

The first signal line 304 is formed, for example, on the surface of the first conductive plane 308 side of the second dielectric layer 318. The first signal line 304 may be disposed at an arbitrary position, as long as it is between the first conductive plane 308 and the second conductive plane 310. For example, the first signal line 304 may he formed on the second conductive plane 310 side of the first dielectric layer 316. In the example shown in FIG. 11, the first signal line 304 is disposed between the first conductive plane 308 and the second conductive plane 318 and below the radiating element 302. A part of the first signal line 304 may be disposed below the center part (for example, the center) of the radiating element 302.

When a signal is fed or when electromagnetic waves are received by the radiating element 302, the first signal line 304 excites the radiating element 302 by proximity coupled feed. By doing this, the radiating element 302 transmits and receives first polarized waves parallel to the longitudinal direction (X direction in FIG. 11) of the first signal line 304. The first signal line 304, for example, may be a transmitting signal line that carries a transmitted signal of the planar antenna 300.

The second conductive plane 310 is formed on the surface of the side of the second dielectric layer 318 opposite from the first conductive plane 308. The second conductive plane 310 may be located at any position, as long as the first signal line 304 is positioned between the first conductive plane 308 and the second conductive plane 310. For example, the second conductive plane 310 may be formed on the first conductive plane 308 side of the third dielectric layer 320. The slot 314 is formed in the second conductive plane 310 as an aperture therein. The plan-view shaped of the slot 314 is, for example, rectangular. The second conductive plane 310, in which the slot 314 is formed, is positioned below the first signal line 304, with the second dielectric layer 318 therebetweeen. The center part (for example, the center) of the slot 314 is disposed below at the center part (for example, the center) of the radiating element 302. The slot 314 is disposed so that the longitudinal direction (X direction in FIG. 11) thereof is substantially parallel to the longitudinal direction of the first signal line 304.

The second signal line 306 is formed, for example, on the third conductive plane 312 side of the third dielectric layer 320. The plan-view shape of the second signal line 306 is, for example, rectangular. The second signal line 306 may be disposed at any arbitrary position, as long as it is between the second conductive plane 310 and the third conductive plane 312. For example, the second signal line 310 may be disposed on the second conductive plane 310 side of the forth dielectric layer 322. In the example shown in FIG. 11 to FIG. 13, a part of the second signal line 306 is disposed below the center part (for example, the center) of the radiating element 302, and longitudinal direction (Y direction in FIG. 11) of the second signal line 306 is disposed to be substantially perpendicular to the longitudinal direction of the slot 314.

When a signal is fed or when electromagnetic waves are received by the radiating element 302, the second signal line 306 excites the radiating element 302 by slot-coupled feed via the slot 314. By doing this, the radiating element 302 transmits and receives second polarized waves substantially perpendicular to the longitudinal direction of the slot 314, that is, substantially perpendicular to the first polarized waves. The second signal line 306, for example, may be a receiving signal line that receives radio waves that have reached the planar antenna 300.

The third conductive plane 312 is formed, for example, by patterning onto the plane of the lower side of the fourth dielectric layer 322. This forms the third conductive plane 312 on the lower side of the second signal line 306. The third conductor plane 312 is an electrically conductive material patterned onto the surface of the fourth dielectric layer 322.

In the planar antenna 300 of the third embodiment, similar to the above-described first and second embodiments, the first signal line 304, the first conductive plane 308 and second conductive plane 310 function as a first strip-line 340. The first strip-line 340 electromagnetically couples the radiating element 302 and the first signal line 304 and causes the planar antenna 300 to operate as a proximity-coupling fed patch antenna. In the planar antenna 300, the radiating element 302 excites a parallel-plate mode between the first conductive plane 308 and the second conductive plane 310. Additionally, in the planar antenna 300 of the third embodiment, the second signal line 306, the second conductive plane 310, and the third conductive plane 312, as shown in FIG. 13, function as a second strip-line 350. The second strip-line 350 electromagnetically couples the radiating element 302 and the second signal line 306 via the slot 314, and causes the planar antenna 300 to operate as a slot-coupling fed patch antenna. In the planar antenna 300, a parallel-plate mode is excited by the slot 314 and the parallel-plate mode is excited between the second conductive plane 310 and the third conductive plane 312.

In the planar antenna 300 of the third embodiment, in order to reduce electromagnetic coupling between the first signal line 304 and the second signal line 306, they are disposed perpendicularly. This causes the planar antenna $00 to operate as a dual polarized antenna that transmits and receives orthogonally polarized waves. The planar antenna 300 is not restricted to being a dual linearly dual polarized antenna, and may be a dual circularly dual polarized antenna. Circular polarization is the synthesis of two orthogonal linearly polarized waves with a phase difference of 90 degrees therebetween. In order to operate the planar antenna 300 as a circularly polarized patch antenna, a 90-degree phase difference can be imparted when feeding the radiating element 302 from first signal line 304 and the second signal line 306.

The first conductive vias 324 are formed so as to pass through the first dielectric layer 316 in the thickness direction. The first conductive vias 324 have one end on the upper side (positive Z direction in FIG. 13) that is electrically connected with the first conductive plane 308. The first conductive vias 324 and the first conductive plane 308 may be mutually opposing, and spaced at a distance so that, when a signal is fed to the first signal line 304 or when electromagnetic waves are received by the radiating element 302, the first conductive vias 324 and the first conductive plane 308 are capacitively coupled to each other. The ends of the first conductive vias 324 on the second conductive plane 310 side are aligned with the second conductive vias 326 provided in the second dielectric layer 318, which neighbors with the first dielectric layer 316, along a normal line direction of the lamination plane. The first conductive vias 324 are disposed in the periphery around the radiating element 302 in the lamination plane (XY plan in FIG. 11). The periphery around the radiating element 302 means the outside of the periphery in the lamination plane. It is sufficient that the periphery .of the radiating element 302 be a region in which a parallel-plate mode is excited between the first conductive plane 308 and the second conductive plane 310. The first conductive vias 324 are formed in the periphery around the radiating element 302, for example at the end 304*a* side in the longitudinal direction of the first signal line 304, the sides of the first signal line 304 in the longitudinal direction, and at the base side of the first signal line 304.

The second conductive vias 326 are formed so as to pass through the second dielectric layer 318 in the thickness direction. The second conductive vias 326 have ends on the first conductive plane 308 side that are aligned with the first conductive vias 324 provided in the first dielectric layer 316, which neighbors with the second dielectric layer 318 along a normal line direction of the lamination plane. One end of the second conductive vias 326 on the lower side (negative Z direction in FIG. 13) electrically connected with the second conductive plane 310. The ends of the second conductive vias 326 on the lower side may be opposite to and space apart from the second conductive plane 310 by a distance so that, when a signal is fed to the first signal line 304 or when electromagnetic waves are received by the radiating element 302, the second conductive vias 326 and the second conductive plane 310 are capacitively coupled to each other. This disposes the second conductive vias 326 in the periphery around the radiating element 302 in the lamination plane. The periphery around the radiating element 302 is the periphery in the lamination plane, that is, outside the orthographically projected region 302*a*-1 when the radiating element 302 is projected in the normal line direction of a plane such as the second dielectric layer 318. It is sufficient that the periphery around the radiating element 302 be a region in which a parallel-plate mode is excited between the first conductive plane 308 and the second conductive plane 310. The second conductive vias 326 are formed in the periphery around the radiating element 302, for example, on the end 304*a* side in the longitudinal direction of the first signal line 304, the sides of the first signal line 304, and the base side of the first signal line 304.

The third conductive vias 328 are formed so as to pass through the third dielectric layer 320 in the thickness direction. Ends of the third conductive vias 328 on the upper side (positive Z direction in FIG. 13) are spaced apart from, and are opposite to the second conductive plane 310, and capacitively couples with the second conductive plane 310 when a signal is fed to the second signal line 306 or when electromagnetic waves are received by the radiating element 302. Ends of the third conductive vias 328 are aligned with the fourth conductive vias 330 provided in the fourth dielectric layer 322 neighboring to the third dielectric layer 320, along the normal line direction of the lamination plane. This disposes the third conductive vias 328 in the periphery around the radiating element 302 in the lamination plane. The periphery around the radiating element 302 is the periphery in the lamination plane, that is, outside the orthographically projected region 302*a*-2 when the radiating element 302 is projected in the normal line direction of a plane such as the third dielectric layer 320. It is sufficient that the periphery around the radiating element 302 is a region in which a parallel-plate mode is excited between the second conductive plane 310 and the third conductive plane 312. The third conductive vias 328 are formed in the periphery around the radiating element 302, for example, on the end 306*a* side in the longitudinal direction of the second signal line 306, the sides of the second signal line 306 in the longitudinal direction, and the base side of the second signal line 306.

The fourth conductive vias 330 are formed so as to pass through the fourth dielectric layer 322 in the thickness direction. The fourth conductive vias 330 have one end on the second conductive plane 310 side aligned with the third conductive vias 328 provided in the third dielectric layer 320, which neighbors with the fourth dielectric layer 322, along a normal line direction of the lamination plane. Ends of the fourth conductive vias 330 on the lower side (negative Z direction in FIG. 13) are electrically connected with the third conductive plane 312. The lower-side ends of the fourth conductive vias 330 may be spaced at a distance from the third conductive plane 312 so that, when a signal is fed to the second signal line 306 or electromagnetic waves are received by the radiating element 302, the fourth conductive vias 330 and the third conductive plane 312 are capacitively coupled to each other. This disposes the fourth conductive vias 330 in the periphery around the radiating element 302 in the lamination plane. The periphery around radiating element 302 is the periphery in the lamination plane, meaning outside the region 302*a*-3, which is the orthographic projection of the radiating element 302 projected along the normal line direction of the plane of, for example the fourth dielectric layer 322. It is sufficient that the periphery around the radiating clement 302 be a region in which a parallel-plate mode is excited between the second conductive plane 310 and the third conductive plane 312. The fourth conductive vias 330 are formed in the periphery around the radiating element 302 and, for example, on the end 306*a* side of the second signal line 306 in the longitudinal direction, on the sides of the second signal line 306 in the longitudinal direction, and at the base side of the second signal line 306.

Similar to the above-described embodiments, the first conductive vias 324 and the second conductive vias 326 are aligned along a normal line direction of the lamination plane (Z direction in the left drawing of FIG. 4), such as shown the left drawing in FIG. 4. The first conductive vias 324 and the second conductive vias 326 are disposed so that, they are partially in proximity at least. The first conductive vias 324 and the second conductive vias 326 being in proximity means that they are opposite to and spaced apart by a distance at which, when a signal is fed to the first signal line 304 or when electromagnetic waves are received by the radiating element 302, the first conductive vias 324 and the second conductive vias 326 are capacitively coupled. At least a part of the first conductive vias 324 and the second conductive vias 326 may be in contact and electrically connected.

Similar to the above-described embodiments, as shown in the left drawing in FIG. 4, the third conductive vias 328 and the fourth conductive vias 330 are aligned along a normal line direction (Z direction of the left drawing in FIG. 4) of the lamination plane. The third conductive vias 328 and the fourth conductive vias 330 are disposed so that they are at least in partial proximity. The third conductive vias 328 and the fourth conductive vias 330 being in proximity means that the third conductive vias 328 and the fourth conductive vias 330 are separated by a distance at which, when a signal is fed to the second signal line 306 or when electromagnetic waves are received by the radiating element 302, a capacitive coupling is made therebetween. At least a part of the third conductive vias 328 and the fourth conductive vias 330 may be in contact and electrically connected.

The first conductive vias 324 and second conductive vias 326 and the third conductive vias 328 and fourth conductive vias 330 need not be aligned along a normal direction of the lamination plane. The reason for this is that a parallel-plate mode generated between the first conductive plane 308 and the second conductive plane 310 are suppressed by high-frequency current flowing in the first conductive plane 308, the first conductive vias 324, the second conductive vias 326, and the second conductive plane 310, and that a parallel-plate mode generated between the second conductive plane 310 and the third conductive plane 312 are suppressed by high frequency current flowing in the second conductive plane 310, the third conductive vias 328, the fourth conductive vias 330, and the third conductive plane 312.

As described above, in the planar antenna 300 of the third embodiment, the first conductive vias 324 provided in the first dielectric layer 316 and the second conductive vias 326 provided in the second dielectric layer 318 are aligned along the normal line direction of the lamination plane. Also, in the planar antenna 300 of the third embodiment, the third conductive vias 328 provided in the third dielectric layer 320 and the fourth conductive vias 330 provided in the fourth dielectric layer 322 are aligned along the normal line direction of the lamination plane. Thus, according to the planar antenna 300 of the third embodiment, high-frequency current flows the first conductive plane 308, first conductive vias 324, the second conductive vias 326 and second conductive plane 310, thereby suppressing the parallel-plate mode propagation between the first conductive plane 308 and the second conductive plane 310. Also, according to the planar antenna 300 of the third embodiment, high-frequency current flowing the second conductive plane 310, third conductive vias 328, the fourth conductive vias 330 and the third conductive plane 312 suppresses the parallel-plate mode propagation between the second conductive plane 310 and the third conductive plane 312. As a result, the planar antenna 300 of the third embodiment can achieve an antenna device with high efficiency. Additionally, according to the planar antenna 300 of the third embodiment, similar to the above-described embodiments, reductions in the aspect ratios (as described earlier) of the first conductive vias 324, the second conductive vias 326, the third conductive vias 328, and the fourth conductive vias 330 improve the reliability of suppressing effect of the parallel-plate mode propagation.

(Fourth Embodiment)

Figure 14:
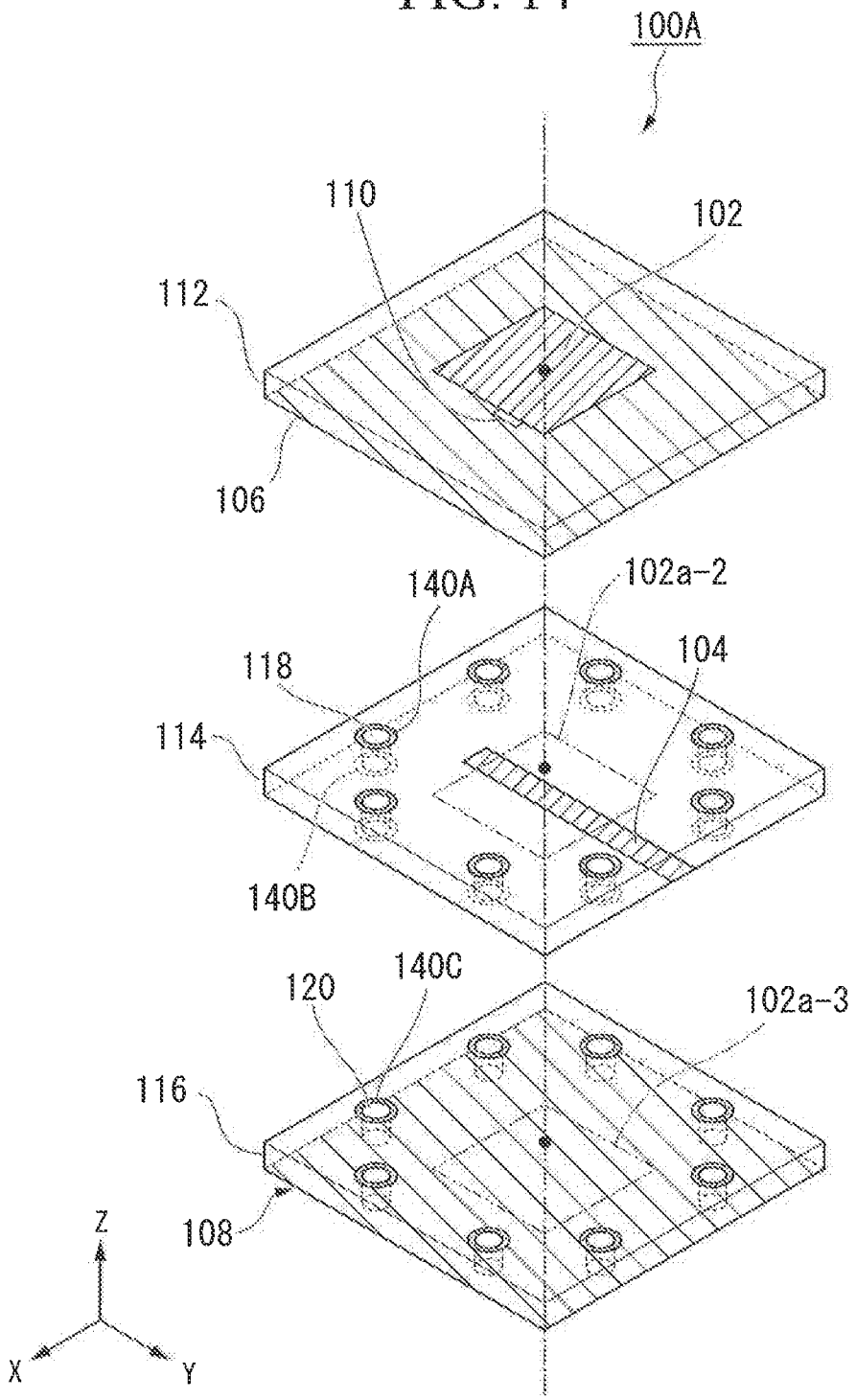
FIG. 14 is an exploded perspective view of a planar antenna of a fourth embodiment.
Figure 15:
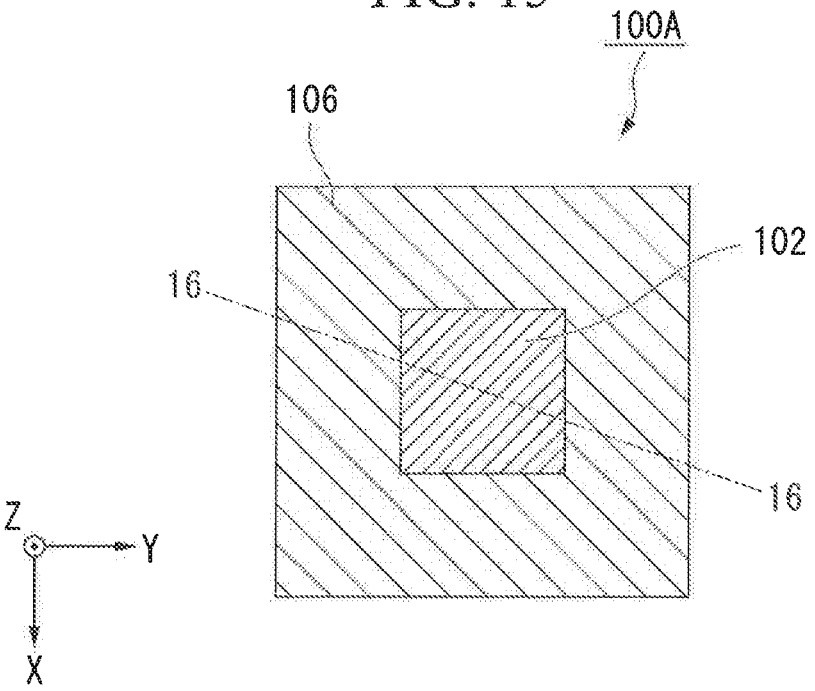
FIG. 15 is atop plan view of the planar antenna of the fourth embodiment.
Figure 16:
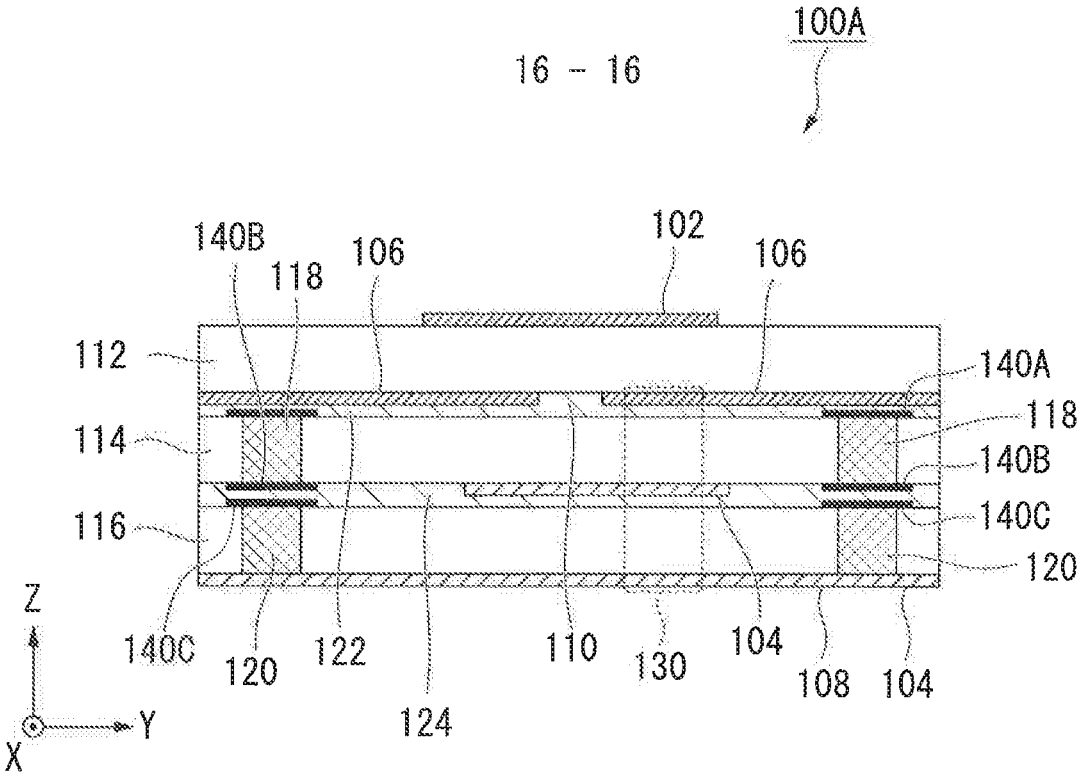
FIG. 16 is a cross-sectional view of the planar antenna of the fourth embodiment, along the line 16-16.

The planar antenna 100A of the fourth embodiment will now be described. in the following description, parts that are the same as in the first embodiment are assigned the same reference symbols and the detailed descriptions thereof will be omitted. Although the planar antenna 100A of the fourth embodiment is a variation of the planar antenna 100 of the first embodiment, this is not a restriction, and it may be applied to the planar antenna 200 of the second embodiment and the planar antenna 300 of the third embodiment. FIG. 14 is an exploded perspective view of the planar antenna 100A of the fourth embodiment. FIG. 15 is a top plan view of the planar antenna 100A of the fourth embodiment. FIG. 16 is a cross-sectional view of the planar antenna 100A of the fourth embodiment, along the line 16-16.

In the planar antenna 100A of the fourth embodiment, conductive vias provided in the multi-layered dielectric substrate are connected to conductive patterns formed on the surface of the side of the dielectric layer that neighbors the dielectric layer in which they themselves are provided. As shown in FIG. 14, the planar antenna 100A has first conductive patterns 140A, second signal line patterns 140B, and third conductive patterns 140C.

The first conductive patterns 140A are between the first conductive plane 106 and the first conductive vias 118. The first conductive patterns 140A and the first conductive plane 106 face to each other. The first conductive patterns 140A are land-shaped, for example, annular. The first conductive patterns 140A are not restricted to being land-shaped, and may be formed to have a surface area larger than a land on the surface of the first conductive plane 106 side of the second dielectric layer 114. First conductive patterns 140A are each connected to one end of the first conductive plane 106 side of a first conductive vias 118.

As shown in FIG. 16, at least a part of the first conductive vias 118, to which the first conductive patterns 140A is connected, is opposed to the first conductive plane 106 in the normal line direction of the lamination plane. The first conductive vias 118, to which the first conductive patterns 140A are connected, are separated from the first conductive plane 106 by a distance at which, when a signal is fed to the first signal line 104 or when electromagnetic waves are received by the radiating element 102, the first conductive vias 118 and the first conductive plane 106 are capacitively coupled to each other. At least a part of the first conductive vias 118, to which the first conductive patterns 140A are connected, may be in contact with and be electrically connected with the first conductive plane 106.

The second conductive patterns 140B are between the first conductive vias 118 and the second conductive vias 120. The second conductive patterns 140B are faced the third conductive pattern 140C. The second conductive patterns 140B are connected directly with the first conductive vias 118. The second conductive patterns 140B are land-shaped, for example, annular. The second conductive patterns 140B are not restricted to being land-shaped, and may be formed to have a surface area larger than a land on the surface of the second conductive plane 108 side of the second dielectric layer 114. The second conductive patterns 140B are each connected to one end of the second conductive plane 108 side of first conductive vias 118.

The third conductive patterns 140C are between the first conductive vias 118 and the second conductive vias 120. The third conductive patterns 140C are connected directly with the second conductive vias 120. The third conductive patterns 140C are land-shaped, for example annular. The third conductive patterns 140C are not restricted to being land-shaped, and may be formed to have a surface area larger than a land on the surface of the first conductive plane 106 side of the third dielectric layer 116. The third conductive patterns 140C are each connected to one end of the first conductive plane 106 side of a second conductive vias 120.

As shown in FIG. 16, a part of the first conductive vias 118 face to the second conductive vias 120 and the third conductive pattern 140C in the normal line direction of the lamination plane. The first conductive vias 118 are connected to the second conductive patterns 140B. The first conductive vias 118, to which the second conductive patterns 140B are connected, are spaced apart from the third conductive patterns 140C by a distance at which the first conductive vias 118 capacitively couple with either the first second vias 120 or the third conductive patterns 140C when a signal is fed to the first signal line 104 or when electromagnetic waves are received by the radiating element 102. At least a part of the first conductive vias 118, to which the second conductive patterns 140B are connected, may be in contact with and be electrically connected with the end faces of the second conductive vias 120 or the third conductive patterns 140C.

As shown in FIG. 16, a part of the second conductive vias 120 face to the first conductive vias 118 and the second conductive pattern 140B in the normal line direction of the lamination plane. The second conductive vias 120 are connected to the third conductive patterns 140C. The second conductive vias 120, to which the third conductive patterns 140C are connected, are spaced apart from the second conductive patterns 140B by a distance at which the second conductive vias 120 capacitively couple with either the first conductive vias 118 or the second conductive patterns 140B when a signal is fed to the first signal line 104 or when electromagnetic waves are received by the radiating element 102. At least a part of the second conductive vias 120, to which the third conductive patterns 140C are connected, may be in contact with and be electrically connected with the end faces of the first conductive vias 118 or the second conductive patterns 140B.

Figure 17:
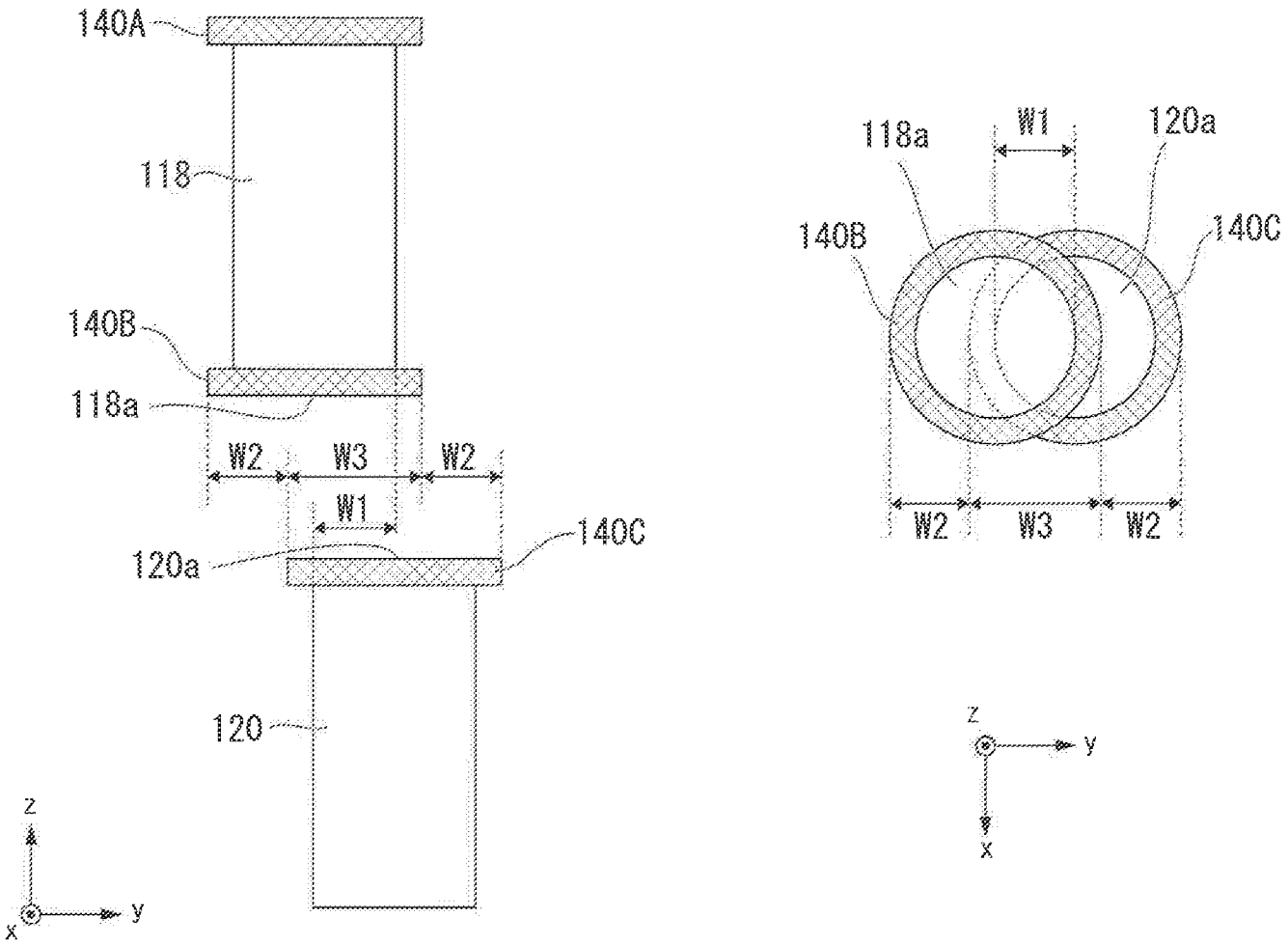
FIG. 17 is a drawing describing the positional relationship, in the planar antenna of the fourth embodiment, among the first conductive via, the second conductive via, the first conductive pattern, the second conductive pattern, and the third conductive pattern.

The first conductive vias 118, which are provided in the second dielectric layer 114 and to which the first conductive patterns 140A and the second conductive patterns 140B are connected, are aligned with the second conductive vias 120 that are provided in the third dielectric layer 116 and to which the third conductive patterns 140C are connected in the normal line direction of the lamination plane. The second conductive vias 120, which are provided in the third dielectric layer 116 and to which the third conductive patterns 140C are connected, are aligned with the first conductive vias 118 provided in the second dielectric layer 114 and to which the first conductive patterns 140A and the second conductive patterns 140B are connected in the normal line direction of the lamination plane. FIG. 17 is a drawing describing the positional relationship, in the planar antenna 100A of the fourth embodiment, among the first conductive via 118, the second conductive via 120, the first conductive pattern 140A, the second conductive pattern 140B, and the third conductive pattern 140C. FIG. 17 describes the positional relationship of first conductive vias 118, to which a first conductive pattern 140A and a second conductive pattern 140B are connected, and second conductive vias 120, to which a third conduct pattern 140C is connected. The left drawing in FIG. 17 shows, in schematic form, how the first conductive via 118, to which the first conductive pattern 140A and the second conductive pattern 140B are connected, and the second conductive vias 120, to which the third conductive pattern 140C is connected, are aligned along a normal line direction of the lamination plane. The right drawing in FIG. 17 shows, in schematic form, the positional relationship between first conductive vias 118, to which a first conductive pattern 140A and a second conductive pattern 140B are connected, and second conductive vias 120, to which a third conductive pattern 140C is connected, when seen in plan view.

As shown in the left drawing of FIG. 17, the first conductive vias 118, to which the first conductive patterns 140A and the second conductive patterns 140B are connected, and the second conductive vias 120, to which the third conductive patterns 140C are connected, are aligned along the normal line direction (Z direction in the left drawing of FIG. 17) of the lamination plane. The normal line direction of the lamination plane may, be the normal line direction of the first conductive plane 106 or may be the normal line direction of the second conductive plane 108. If the first conductive plane 106 and the second conductive plane 108 are laminated in parallel, the normal line directions of the first conductive plane 106 and the second conductive plane 108 coincide. The first conductive vias 118, to which the first conductive patterns 140A and the second conductive patterns 140B are connected, and the second conductive vias 120, to which the third conductive patterns 140C are connected, being aligned along the normal line direction of the lamination plane, as shown in the right drawing of FIG. 17, refers to at least a partial overlap, when seen in plan view, between the end faces 118*a* on the second conductive plane 108 side of the first conductive vias 118 and the second conductive patterns 140B, and, the end faces 120*a* on the first conductive plane 106 side of the second conductive vias 120 and the third conductive patterns 140C. The opposing width W3 and the offset width W2 between the end face 118*a* on the second conductive plane 108 side of a first conductive via 118 and the second conductive patterns 140B, and the end faces 120*a* on the first conductive plane 106 side of a second conductive via 120 and the third conductive patterns 140C are dependent upon the positional offset between the second dielectric layer 114 and third dielectric layer 116 when laminated. The opposing width W3 between the end face 118*a* on the second conductive plane 108 side of the first conductive via 118 and the second conductive patterns 140B and the end face 120*a* on the first conductive plane 106 side of the second conductive via 120 and the third conductive patterns 140C are larger than the opposing width WI between the end face 118*a* on the second conductive plane 108 side of first conductive vias 118 and the end face 120*a* on the first conductive plane 106 side of the second conductive via 120.

As described above, according to the planar antenna 100A of the fourth embodiment, conductive vias provided in the multi-layered dielectric substrate are connected to conductive patterns formed on the surface of the dielectric layer that neighbors the dielectric layer in which they themselves are provided. By doing this, according to the planar antenna 100A of the fourth embodiment, between neighboring substrates, because it is possible to increase the opposing surface area between conductive vias and conductive patterns and to increase the capacitance formed between the first conductive vias 118, to which the second conductive patterns 140B are connected, and the second conductors vias 120, to which the third conductive patterns 140C are connected, the flow of high-frequency current between the first conductive vias 118, to which the second conductive patterns 140B are connected, and the second conductive vias 120, to which the third conductive patterns 140C are connected, is facilitated. According to the planar antenna 100A of the fourth embodiment, because the capacitance formed between the first conductive plane 106 and the first conductive vias 118, to which the first conductive patterns 140A are connected, can be increased, the flow of high-frequency current between the first conductive plane 106 and the first conductive vias 118, to which the first conductive patterns 140A are connected, is facilitated, enabling the flow of a higher high-frequency current in the first conductive plane 106 and the first conductive vias 118 conductive via. As a result, according to the planar antenna 100A of the fourth embodiment, it is possible to further suppress the parallel-plate mode propagation, and to achieve an antenna device with higher efficiency.

In the planar antenna 100A of the fourth embodiment, if at least a part of the first conductive plane 106 and the first conductive vias 118, to which the first conductive patterns 140A are connected, is electrically connected, the flow of high-frequency current between the first conductive plane 106 and the first conductive vias 118, to which the first conductive patterns 140A are connected, is facilitated, it is possible to further suppress the parallel-plate mode propagation, and it is possible to achieve an antenna device with higher efficiency.

In the planar antenna 100A of the fourth embodiment, if at least apart of the first conductive vias 118, to which the second conductive patterns 140B are connected, and the second conductive vias 120, to which the third conductive patterns 140C are connected, is disposed so as to the electrically connected, the flow of high-frequency current between the first conductive vias 118, to which the second conductive patterns 140B are connected, and the second conductive vias 120, to which the third conductive patterns 140C are connected, is further facilitated, and it is possible to further the suppress parallel-plate mode propagation and to achieve an antenna device with higher efficiency.

In the planar antenna 100A of the fourth embodiment, there is also a case in which, in the pressing processing step, the first conductive patterns 140A break the first adhesive layer 122, so that the first conductive plane 106 and the first conductive patterns 140A make contact and are electrically connected For example, if the shape of the first conductive patterns 140A is like a land shape, and the covering ratio of the metal on the surface of the dielectric layer on which the land is formed is small and the thickness of the first adhesive layer 122 is approximately the same as, or smaller than the thickness of the first conductive patterns 140A, the adhesive layer might be broken by the conductive patterns at the time of the pressing process step, thereby causing a possibility of an electrical connection between the conductor and the metal pattern. Even in this ease, according to the planar antenna 100A of the fourth embodiment, it is possible to cause a large high-frequency current to flow between, the first conductive plane 106 and the second conductive plane 108, thereby improving the suppressing effect of the parallel-plate mode propagation.

Also, in the planar antenna 100A of the fourth embodiment, there also is a cases in which, in the pressing process step, the second conductive patterns 140B and the third conductive patterns 140C break the second adhesive layer 124, so that the second conductive patterns 140B and the third conductive patterns 140C make contact and are electrically connected. For example, even if the shape of the second conductive patterns 140B and the third conductive patterns 140C are like land shapes, and the covering ratio of the metal (for example the first signal line 104) on the surface of the dielectric layer on which the land is formed is small and the thickness of the second adhesive layer 124 is approximately the same as or smaller than the thickness of the second conductive patterns 140B and the third conductive pattern 140C, so that the conductive patterns might break the adhesive layer at the pressing process step and the metal patterns might be electrically connected, according to the planar antenna 100A of the fourth embodiment, it is possible to cause a large high-frequency current to flow between the first conductive plane 106 and the second conductive plane 108, thereby improving the suppressing effect of the parallel-plate mode propagation.

Additionally, according to the planar antenna 100A of the fourth embodiment, because the second conductive patterns 140B and the third conductive patterns 140C are formed on the opposing surfaces of the second dielectric layer 114 and the third dielectric layer 116, the robustness with respect to positional offset between layers of laminated material can be improved, thereby enabling avoidance of deterioration of antenna characteristics such as reflection characteristics due to positional offset between layers of laminated material. Additionally, according to the fourth embodiment, it is possible to avoid deterioration of cross-polarization discrimination, with a constitution such as in the third embodiment, and it is also possible to improve the isolation between ports connected to the first signal line 304 and the second signal line 306.

(Fifth Embodiment)

Figure 18:
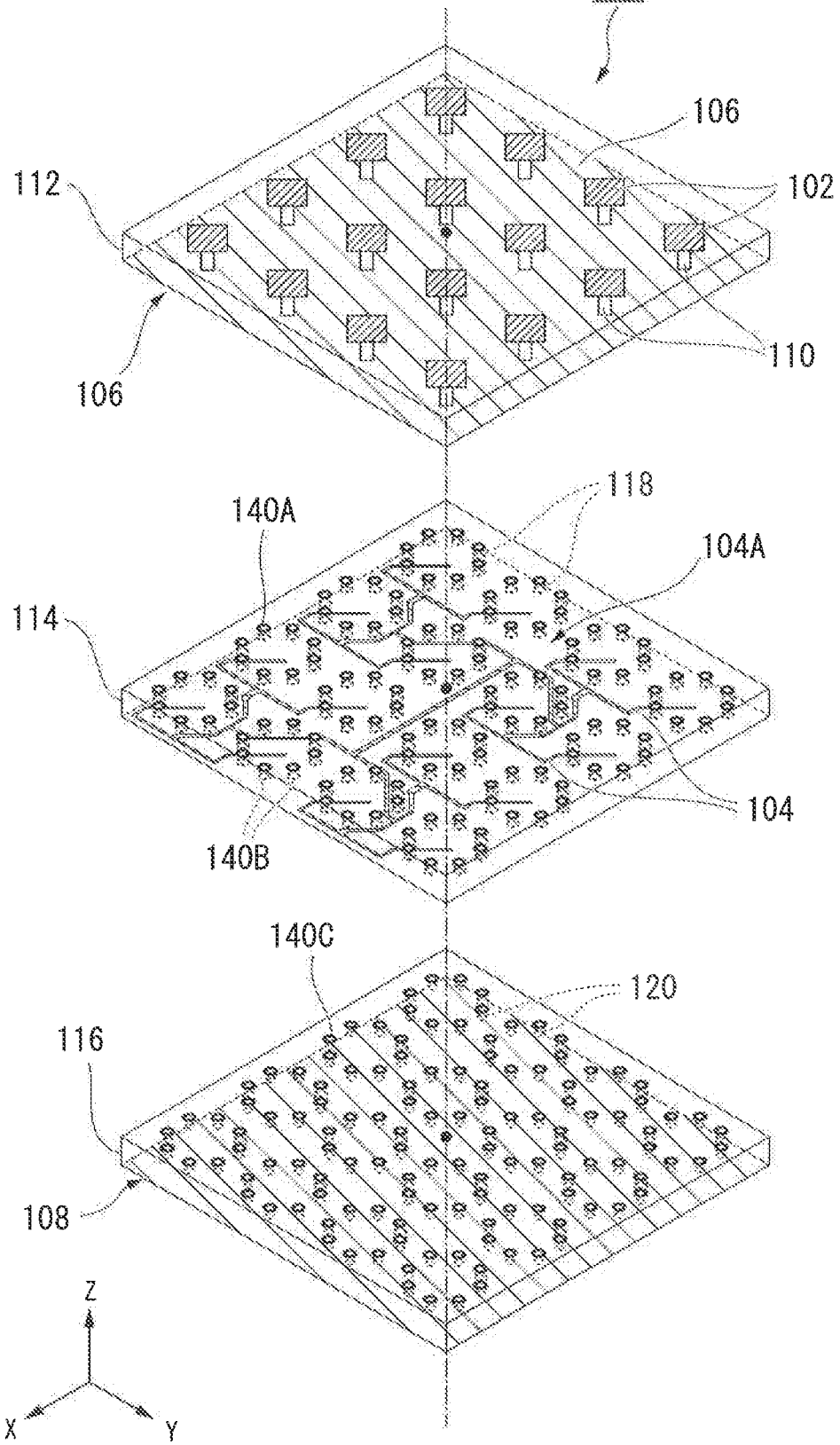
FIG. 18 is an exploded perspective view of a planar antenna of a fifth embodiment.

The planar antenna 400 of the fifth embodiment will now be described. In the following description, parts that are the same as in the above-described embodiments are assigned the same reference symbols and the detailed descriptions thereof will be omitted. Although the planar antenna 400 of the fifth embodiment is a variation of the planar antenna 100A of the fourth embodiment, this is not a restriction, and it may he applied to the planar antenna 200 of the second embodiment and the planar antenna 300 of the third embodiment. FIG. 18 is an exploded perspective view of the planar antenna 400 of the fifth embodiment.

The planar antenna 400 of the fifth embodiment is an array antenna device in which a plurality of radiators are disposed. The planar antenna 400 of the fifth embodiment has a plurality of radiating elements 102, a plurality of slots 110, and a feeder circuit 104A having a plurality of signal lines 104. The plurality of slots 110 and the plurality of signal lines 104 are each provided in correspondence to the plurality of radiating elements 102.

Figure 19:
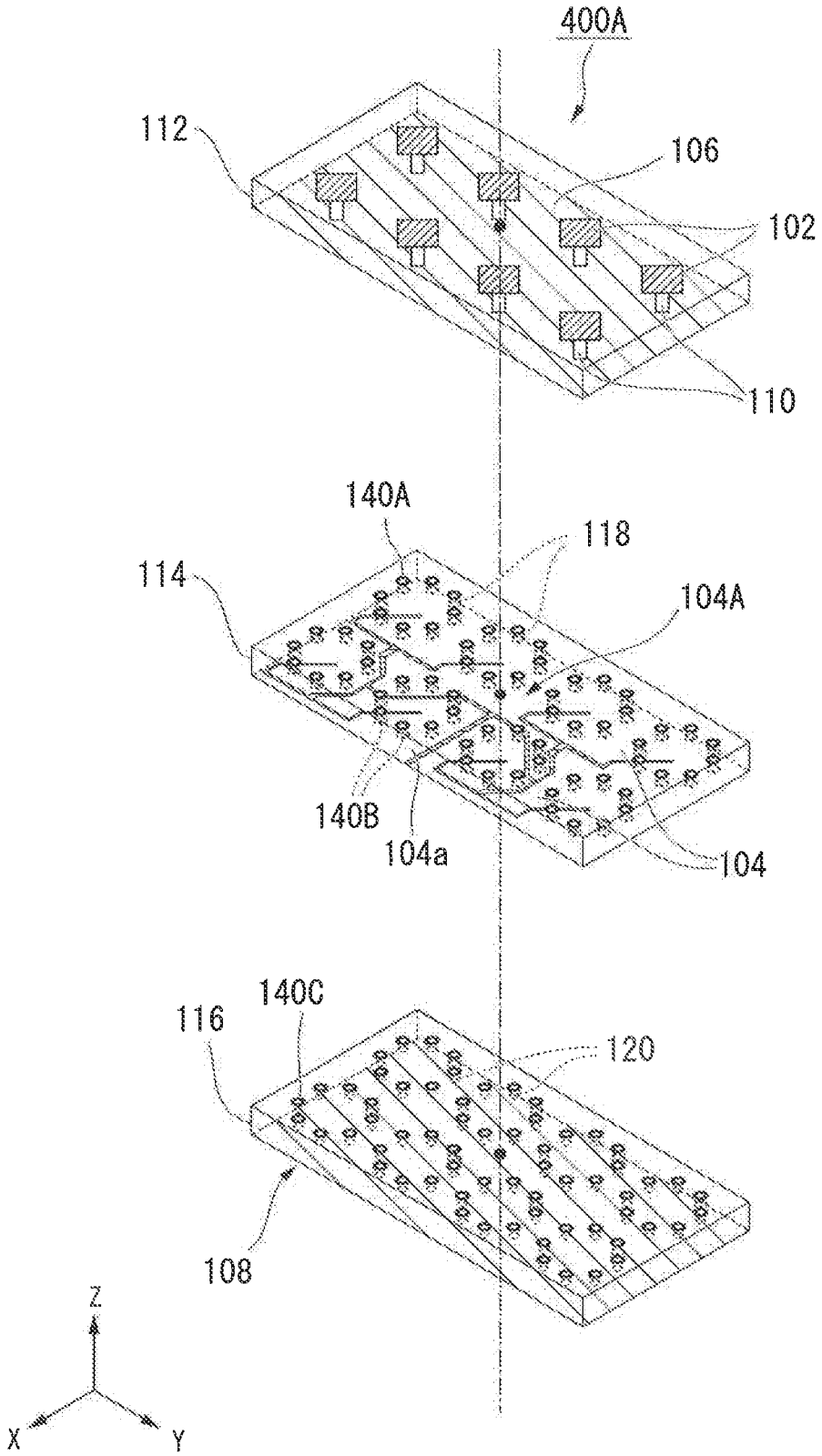
FIG. 19 is an exploded perspective view of another planar antenna of the fifth embodiment.

The plurality of radiating elements 102 is arranged in a two-dimensional matrix above the surface of the first dielectric layer 112 side (positive Z direction in FIG. 18). The plurality of radiating elements 102 is provided in a $2^N \times 2^N$ two-dimensional matrix, where N is an arbitrary natural number. The plurality of radiating elements 102 may alternatively be provided in a $2^N \times 2^{N-1}$ two-dimensional matrix, where N is an arbitrary natural number of 2 or greater. FIG. 19 is an exploded perspective view of another planar antenna 400A of the fifth embodiment. This enables the planar antennas 400 and 400A of the fifth embodiment to form a total full-corporate feed circuit 104A that includes two-way power dividers arranged in multiple stages.

In the second dielectric layer 114, a plurality of first conductive vias 118 each corresponding to a radiating element 102 are formed in peripheries around the radiating elements 102. First conductive patterns 140A formed on the first conductive plane 106 side surface of the second dielectric layer 114 are connected to the first conductive vias 118. Second conductive patterns 140B formed on the second conductive plane 108 side surface of the second dielectric layer 114 are connected to the first conductive vias 118.

A plurality of second conductive vias 120 corresponding to each of the radiating elements 102 are formed in the periphery around the radiating elements 102 in the third dielectric layer 116. Third conductive patterns 140C formed on the first conductive plane 106 side surface of the third dielectric layer 116 are connected to the second conductive vias 120. Ends of the second conductive vias 120 on the second conductive plane 108 side are electrically connected with the second conductive plane 108.

The first conductive plane 106 and the first conductive vias 118 face to each other and are spatially separated from each other. The first conductive vias 118 are connected to the first conductive patterns 140A. The first conductive plane 106 and the first conductive vias 118 are distanced so that the first conductive plane 106 and the first conductive vias 118 are capacitively coupled to each other when a signal is fed to the first signal lines 104 or when electromagnetic waves are received by the radiating elements 102. The second conductive patterns 140B and the third conductive patterns 140C face to each other and are spatially separated from each other. The second conductive patterns 140B are connected to the first conductive vias 118. The third conductive patterns 140C are connected to the second conductive vias 120 and the second conductive plane 108. The second conductive patterns 140B and the third conductive patterns 140C are distanced so that the first conductive vias 118 and the second conductive vias 120 are capacitively coupled to each other when a signal is fed to the first signal lines 104 or when electromagnetic waves are received by the radiating elements 102. The first conductive vias 118 and the second conductive vias 120 are aligned along the normal line direction of the lamination plane.

In the planar antennas 400, 400A, the plurality of signal lines 104, the first conductive plane 106 and second conductive plane 108 function as a strip-line. The plurality of signal lines 104, the first conductive plane 106, and the second conductive plane 108 function as the plurality of strip lines 130 shown in FIG. 3. By doing this, the plurality of strip-lines 130 electromagnetically couple the plurality of radiating elements 102 and the plurality of signal lines 104, via the plurality of slots 110, and cause the planar antennas 400 and 400A to operate as slot-coupling fed patch array antennas. In the planar antennas 400 and 400A, the plurality of slots 110 excite parallel-plate mode waves between the first conductive plane 106 and the second conductive plane 108.

As described above, in the planar antennas 400 and 400A of the fifth embodiment, similar to the above-described embodiments, opposite the first conductive plane 106, the first conductive vias 118 to which the first conductive patterns 140A and the second conductive patterns 140B are connected, and the second conductive vias 120 to which the second conductive plane 108 and the third conductive patterns 140C are connected, are aligned along the normal line direction of the lamination plane. By doing this, according to the planar antennas 400 and 400A, a high-frequency current flows between the first conductive plane 106, the first conductive vias 118 connecting the first conductive patterns 140A and the second conductive patterns 140B, and the second conductive vias 120 conducting the third conductive patterns 140C and the second conductive plane 108, thereby suppressing the parallel plate mode propagation and achieving an antenna device with high efficiency.

In the planar antennas 400 and 400A of the fifth embodiment, if at least a part of the first conductive plane 106 and the first conductive vias 118, to which the first conductive patterns 140A are connected, is disposed to be electrically connected, the flow of a high-frequency current between the first conductive plane 106 and the first conductive vias 118, to which are connected the first conductive patterns 140A, is facilitated, thereby further suppressing the parallel-plate mode propagation and achieving an antenna device with higher efficiency.

In the planar antennas 400 and 400A of the fifth embodiment, if at least a part of the first conductive vias 118, to which the second conductive patterns 140B are connected, and the second conductive vias 120, to which the third conductive patterns 140C are connected, is disposed to be electrically connected, the flow of a high-frequency current between the first conductive vias 118, to which the second conductive patterns 140B are connected, and the second conductive vias 120, to which the third conductive patterns 140C are connected is further facilitated, enabling additional suppression of parallel-plate mode propagation and enabling the achievement of an antenna device with higher efficiency.

According to the planar antennas 400 and 400A of the fifth embodiment, because a plurality of radiating elements 102 are provided in a two-dimensional matrix, it is possible to improve the antenna gain, and possible to communicate with an antenna device that is farther away. Additionally, according to the planar antennas 400 and 400A of the fifth embodiment, because the plurality of radiators is a plurality of radiating elements provided in a two-dimensional $2^N \times 2^N$ or $2^N \times 2^{N-1}$ matrix, where N is a natural number, the construction of the feeder circuit 104A can be simplified.

Additionally, according to the planar antennas 400 and 400A of the fifth embodiment, the propagation of parallel-plate mode occurring between a radiating element 102 and signal lines 104 to other radiating elements 102 and signal lines 104 that neighboring on the lamination plane can be suppressed. Additionally, according to the planar antennas 400 and 400A of the fifth embodiment, similar to the above-described embodiments, the aspect ratio of the first conductive vias 118 and the second conductive vias 120 (as described earlier) can be made small, and the reliability of the first conductive vias 118 and the second conductive vias 120 with respect to suppressing parallel-plate mode waves can be improved.

Variation Example

A variation example of an embodiment will now be described.

Figure 20:
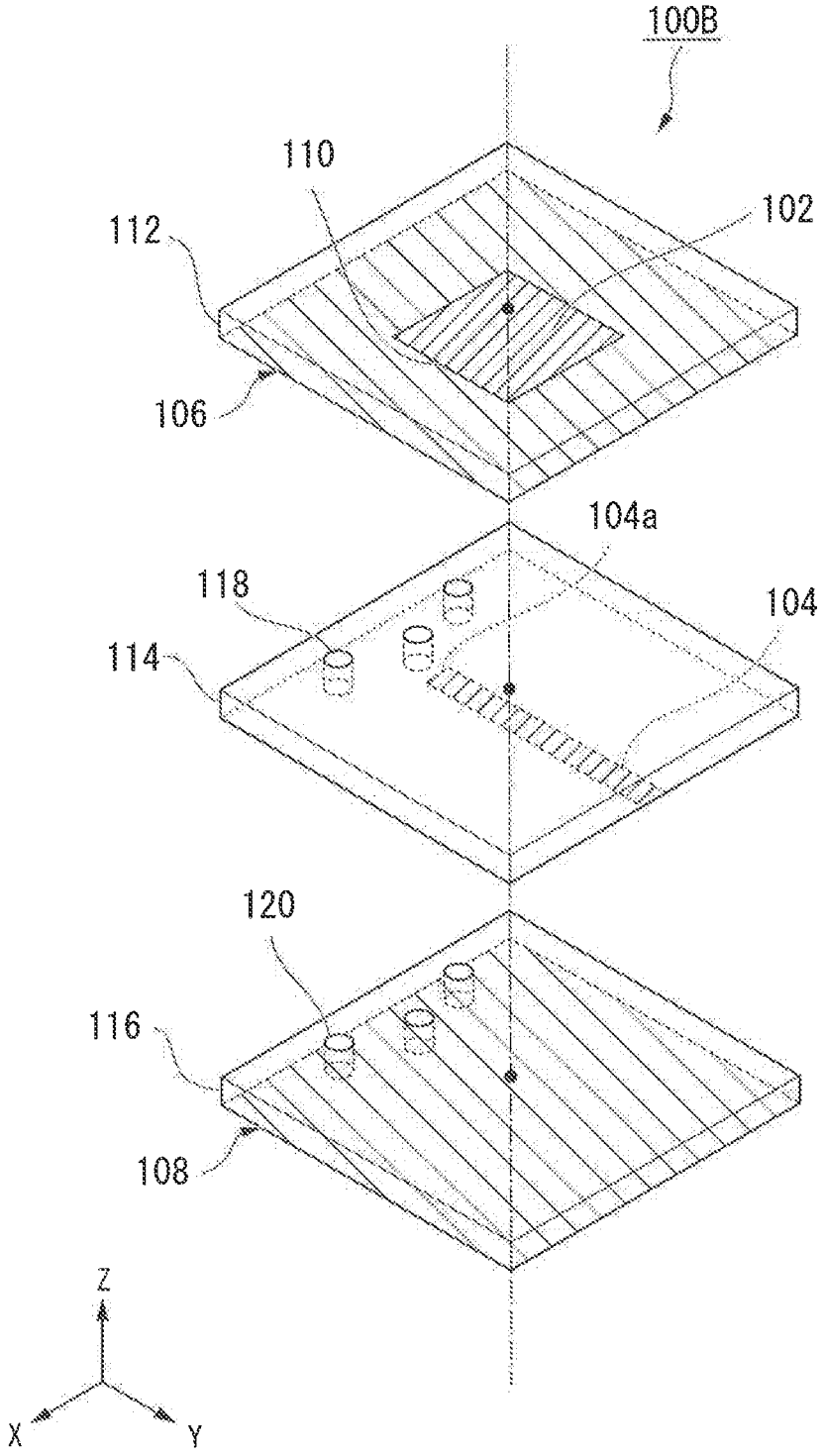
FIG. 20 is an exploded perspective view of a planar antenna of a variation example.

Although in the planar antennas of embodiments described above a plurality of conductive vias are formed in the periphery around the radiator in the lamination plane, on the end 104*a* side of the first signal line 104 in the longitudinal direction, on the sides of the first signal line 104 in the longitudinal direction, and at the base side of the first signal line 104, this is not a restriction. FIG. 20 is an exploded perspective view of a planar antenna 100B of a variation example, in the planar antenna 100B of the variation example, a plurality of first conductive vias 118 and second conductive vias 120 are formed on the end 104*a* side of the first signal line 104 in the longitudinal direction.

According to at least one of the above-described embodiments, by providing in the multi-layered dielectric layer that has a plurality of dielectric layers, each of which has at least a conductive via distanced from the radiator, and the conductive vias in different dielectric layers of the plurality of dielectric layers being aligned to each other, it is possible to avoid a reduction in the effect of suppressing parallel-plate mode propagation by breakage of conductors, and possible to improve the reliability.

While certain embodiments of the present invention have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A planar antenna device comprising: a multi-layered dielectric substrate having a plurality of dielectric layers; a radiating element positioned on the multi-layered dielectric substrate; a first conductive plane having one or more slots on or in the multi-layered dielectric substrate; a second conductive plane on or in the multi-layered dielectric substrate, wherein first and second dielectric layers of the plurality of dielectric layers are disposed between the first and second conductive planes, wherein the first dielectric layer is positioned between the first conductive plane and the second dielectric layer, and wherein the second dielectric layer is positioned between the first dielectric layer and the second conductive plane; a first signal line being between the first and second dielectric layers; a first conductive via in the first dielectric layer, the first conductive via being distanced from the first signal line; and a second conductive via in the second dielectric layer, the second conductive via being distanced from the first signal line, the second conductive via being aligned to the first conductive via, the second conductive via being apart from the first conductive via, and the first conductive via and the second conductive via are separated by a distance; a first conductive pattern connected to a first end of the first conductive via, wherein the first end of the first conductive via faces to the first conductive plane; a second conductive pattern connected to a second end of the first conductive via, the first and second ends of the first conductive via are positioned at opposite ends of the first conductive via; and a third conductive pattern connected to a first end of the second conductive via, wherein the first end of the second conductive via faces to the second conductive pattern.

2. The planar antenna device according to claim 1, wherein the first conductive via and the first conductive plane are in contact directly with each other.

3. The planar antenna device according to claim 1, wherein the first conductive via and the first conductive plane are distant from each other and are capacitively coupled with each other.

4. The planar antenna device according to claim 1, wherein the second conductive pattern and the third conductive pattern are distant from each other and are capacitively coupled with each other.

5. The planar antenna according to claim 1, further comprising:

an adhesive layer between the first and second conductive vias.

6. The planar antenna device according to claim 1, further comprising:

a second signal line being between the radiating element and the first conductive plane.

7. The planar antenna device according to claim 6, further comprising:

a third conductive plane having an aperture on the multi-layered dielectric substrate, wherein the radiating element is disposed inside the aperture.

8. The planar antenna device according to claim 1, wherein the first conductive via and the second conductive via are capacitively-coupled with each other.

* * * * *